US006984030B2

(12) United States Patent
Shinada et al.

(10) Patent No.: US 6,984,030 B2
(45) Date of Patent: Jan. 10, 2006

(54) INK CARTRIDGE AND METHOD OF REGULATING FLUID FLOW

(75) Inventors: Satoshi Shinada, Nagano (JP); Hisashi Miyazawa, Nagano (JP); Akira Ichihashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 197 days.

(21) Appl. No.: 10/706,242

(22) Filed: Nov. 11, 2003

(65) Prior Publication Data

US 2005/0001887 A1 Jan. 6, 2005

(30) Foreign Application Priority Data

Nov. 13, 2002 (JP) ..... P2002-329062

(51) Int. Cl.
*B41J 2/175* (2006.01)

(52) U.S. Cl. ..... 347/86

(58) Field of Classification Search ..... 347/85, 347/84, 86, 87–89
See application file for complete search history.

(56) References Cited

U.S. PATENT DOCUMENTS

| | | | | |
|---|---|---|---|---|
| 4,602,662 A | | 7/1986 | Eremity et al. | |
| 4,677,447 A | * | 6/1987 | Nielsen | 347/87 |
| 4,971,527 A | | 11/1990 | Dick | |
| 5,646,664 A | * | 7/1997 | Pawlowski, Jr. | 347/86 |
| 5,653,251 A | | 8/1997 | Handler | |
| 5,736,992 A | | 4/1998 | Pawlowski, Jr. | |
| 5,737,001 A | | 4/1998 | Taylor | |
| 6,585,358 B2 | * | 7/2003 | Usui et al. | 347/85 |
| 6,824,256 B2 | * | 11/2004 | Thielman et al. | 347/85 |
| 2002/0109760 A1 | | 8/2002 | Miyazawa et al. | |

FOREIGN PATENT DOCUMENTS

| | | |
|---|---|---|
| EP | 1 016 533 A1 | 7/2000 |
| EP | 1 199 178 A1 | 4/2002 |
| EP | 1 258 358 A1 | 11/2002 |
| GB | 2 323 332 A | 9/1998 |
| GB | 2 331 488 A | 5/1999 |
| JP | 8-174860 A | 7/1996 |
| WO | WO-00/03877 A1 | 1/2000 |

OTHER PUBLICATIONS

European search report, dated Mar. 3, 2004, in European Patent Application EP 03 02 6112.

* cited by examiner

*Primary Examiner*—K. Feggins
(74) *Attorney, Agent, or Firm*—Stroock & Stroock & Lavan LLP

(57) ABSTRACT

An ink cartridge has an ink storage chamber, an ink supply port and a negative pressure generating mechanism which selectively blocks and opens fluid communication between the ink storage chamber and the ink supply port as a consequence of ink consumption. The negative pressure generating mechanism includes an elastic member having first and second surfaces and a sealing portion, the sealing portion having a through-hole, an ink flow path communicating with the ink supply port and having an opening portion at a position where the sealing portion of the elastic member contacts with and separates from the opening portion, the opening portion facing the through-hole, and a communicating portion facing the first surface of the elastic member and communicating with the ink storage chamber. A space portion faces the second surface of the elastic member and communicates with the ink supply port.

40 Claims, 20 Drawing Sheets

INK CARTRIDGE AND METHOD OF REGULATING FLUID FLOW

BACKGROUND OF THE INVENTION

The present invention relates to an ink cartridge for supplying ink in a proper negative pressure state to a recording head that ejects ink droplets in response to print signals.

This invention also involves a method for regulating the flow of fluid from an ink cartridge to an ink jet head.

An ink jet recording apparatus is generally configured such that an ink jet recording head for ejecting ink droplets in response to print signals is mounted on a carriage reciprocating in a sheet width direction across a piece of recording paper, and ink is supplied from an external ink tank to the recording head. In case of a small recording apparatus, an ink storage container such as an ink tank is arranged to be removable from the carriage in view of convenience in handling and to facilitate replacement of an exhausted ink tank with a fresh ink tank containing a new supply of ink (or inks, if the tank is a multi-color tank).

In order to prevent leakage of ink from the recording head, such an ink storage container generally includes therein a porous member impregnated with ink so that the capillary force of the porous member holds the ink.

In addition, there is a tendency for the amount of ink consumed to increase, with time, because the continuing development of improved printers leads to an increased number of nozzle openings in order to keep pace with required improvement in print quality and print speed.

In order to accommodate these developments in ink jet printer design, it is preferable to increase the amount of ink that can be stored in the ink storage container, but this leads to an increase in the volume of the porous member. However, in the case where the porous member that holds the ink employs capillary force, the height, i.e. water head, of the porous member is limited, and therefore the bottom area of the ink storage container must be increased in order to increase the container's volume, causing a problem in which the carriage size and thus entire size of the recording apparatus must be increased.

To solve this problem, Japanese Patent Kokai Publication No. Hei. 8-174860 proposes, at paragraphs 0041–0043, and FIG. 10, an ink cartridge in which a membrane member deformable by ink pressure is formed at its center with a through-hole to provide a membrane valve seat, and a valve member is provided at a location opposing the membrane valve seat.

Also to solve this problem, International Patent Publication No. PCT00/03877 proposes an ink cartridge in which a valve member is formed by injection molding of polymer material having elasticity, a through-hole is formed in a center of the valve member, a back surface of the valve member is pressingly contacted with a sealing member by a spring, and the valve member is moved by a negative pressure acting on the back surface of the valve member so that ink flows out only via the through-hole to an ink supply port.

Meanwhile, an ink cartridge having high ink supply performance and which can supply a large amount of ink to a recording head, is needed in order to satisfy the need for such cartridges when used in high speed printing. The most important factor affecting the performance when supplying ink to a recording head is the flow passage resistance within the cartridge.

U.S. Pat. No. 4,602,662 describes an externally-controlled valve for use in liquid marking systems. This reference teaches that an inlet and outlet are located on one side of a movable member, and a spring and external vacuum source are located on the other side of the movable member. The patent specifically states that the spring is not used to seal the valve, but rather, is provided only to prevent siphoning, and the external vacuum source serves to keep the valve closed.

U.S. Pat. No. 4,971,527 involves a regulator valve for an ink marking system. A diaphragm is pressed between two springs and so serves to dampen pressure pulsations in the ink flowing between an inlet and outlet located on one side of the diaphragm.

U.S. Pat. No. 5,653,251 relates to a vacuum actuated sheath valve. While an inlet and outlet are located on the same side of the valve membrane, that membrane itself can perforated, allowing liquid to pass to the other side of the membrane. Moreover, the membrane is stretched over a curved projection, and no spring is used to regulating the valve "cracking" pressure. More specifically, U.S. Pat. No. 5,653,251 discloses a valve structure having a valve member made of an elastically deformable membrane, a convex portion with which the valve member is contactable, and a flow channel formed in the convex portion and closable by the valve member. In the valve structure, negative pressure at the demand side is applied to one surface of the valve member to separate the valve member from the flow channel, to thereby control supply and interruption of the liquid. However, in the valve open state, the area of the valve member receiving the liquid pressure (the pressure-receiving area) is extremely small, meaning that the difference in area between the front and back surfaces of the valve member is large. For this reason, the valve open state cannot be maintained by the small pressure change which results from ink consumption by the recording head. When the valve structure is put into the valve closed state, the pressure-receiving area is extremely large, so that the valve structure is returned to the valve open state. Accordingly, there is a problem in that this operation is undesirably repeated to cause pulsations during the supply of ink, which, it will be appreciated, can adversely affect printing.

In the ink cartridge disclosed in International Patent Publication No. PCT00/03877, the through-hole, which forms an ink flow passage through the membrane member, causes a fluidic resistance, and further, a mutual clearance of the through-hole with respect to the valve member cooperating with the through-hole also causes a large fluidic resistance. Thus, it is difficult to supply a large amount of ink to a recording head, which is recently required for high print speed.

European Patent Application No. 1 199 178 describes an ink cartridge having a differential pressure valve mechanism (U.S. patent application Publn. No. 2002/0109760 is a counterpart). This reference describes valves in which a perforation in a movable membrane is urged by a spring to abut a solid projection.

To reduce the fluidic resistance caused by the through-hole of the membrane member, it is conceivable to make the diameter of the through-hole larger, but since the membrane member must be formed from elastic polymer material, increasing the size of the through-hole will reduce the load per unit area, causing a decrease in the sealing pressure, and thus degrading the valve's sealing ability and reducing cartridge performance.

SUMMARY OF THE INVENTION

The present invention was made, in part, in order to solve these problems.

An object of the present invention is to provide an ink cartridge that can reduce a flow passage resistance acting on ink in a negative pressure generating structure without degrading sealing ability, to thereby allow a high rate of ink consumption from the ink cartridge by a recording head.

Another object of the present invention is to provide an ink cartridge that can be manufactured with excellent yield.

Yet another object of the present invention is to provide a fluid flow controller for a recording head, which can reduce a flow passage resistance acting on ink in a negative pressure generating structure without degrading sealing ability, to thereby allow a high rate of ink consumption by the recording head.

Still another object of the present invention is to provide an ink cartridge in which a flow passage design is simplified.

The present invention provides an ink cartridge, which includes: an ink storage chamber; an ink supply port; and a negative pressure generating mechanism which selectively blocks and opens fluid communication between the ink storage chamber and the ink supply port as a consequence of consumption of ink. The ink negative pressure generating mechanism includes an elastic member having first and second surfaces and a sealing portion, the sealing portion having a through-hole; an ink flow path communicating with the ink supply port and having an opening portion at a position where the sealing portion of the elastic member contacts with and separates from the opening portion, the opening portion facing the through-hole; a communicating portion facing the first surface of the elastic member and communicating with the ink storage chamber; and a space portion facing the second surface of the elastic member and communicating with the ink supply port.

The present invention provides a fluid flow controller for a recording head, which includes: an elastic member having a first and a second surfaces and a sealing portion, and movable in response to a pressure differential between the first and second surfaces, the sealing portion having a through-hole; a communicating portion facing the first surface of the elastic member and adapted to communicate with an ink tank storing ink therein; an ink outflow port; an opening portion of an ink flow path, which communicates with the ink outflow port, wherein the sealing portion of the elastic member is arranged for movement into contact with and separation from the opening portion; and a space portion facing the second surface of the elastic member and communicating with the ink outflow port.

The present invention provides a method of regulating ink flow from an ink cartridge, having an ink supply port, to an ink jet head. The method includes the steps of: providing, as part of the ink cartridge, a valve chamber having a cover and a base, the base having both an inlet and an outlet, the valve chamber containing an elastic membrane having a through-hole, both the inlet and the outlet being disposed on a first side of the elastic membrane, and a space being defined between a second side of the elastic membrane and the cover; and pressing the elastic membrane toward the base with an applied force so that a contact portion of the elastic membrane seals the outlet and the through-hole from the inlet. When a pressure in the space decreases beyond a given value, a resulting pressure differential across the elastic membrane causes the contact portion of the elastic membrane to move away from the outlet against the applied force, thereby communicating the outlet and the through-hole with the inlet.

The present invention provides a negative pressure generating mechanism, which is disposed between an ink storage region and an ink supply port, and has a wall surface having two first and second through-holes for ink flow, and a valve member contacted with and separated from the through-hole by receiving a pressure in an ink supply port side. The valve member has a third through-hole. Ink flowing via the first through-hole is supplied via the second and third through-holes to the ink supply port.

The present disclosure relates to the subject matter contained in Japanese patent application No. 2002-329062 (filed on Nov. 13, 2002), which is expressly incorporated herein by reference in their entireties.

DESCRIPTION OF THE PREFERRED EMBODIMENT

Hereafter, the details of the present invention will be discussed with reference to the illustrated embodiments.

Figure 1:
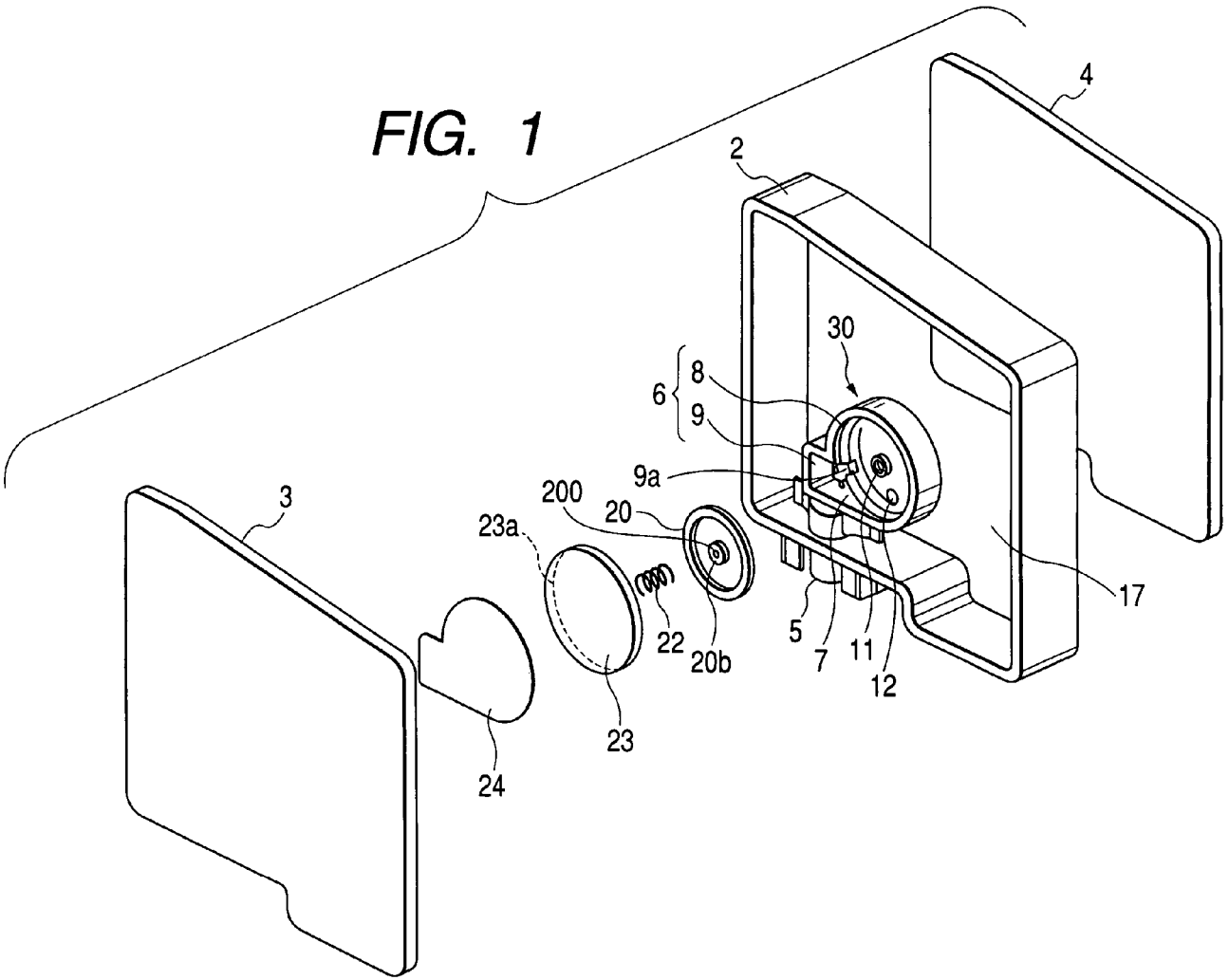
FIG. 1 is an exploded perspective view showing an ink cartridge according to an embodiment of the present invention as viewed from an ink storing chamber side.
Figure 2A:
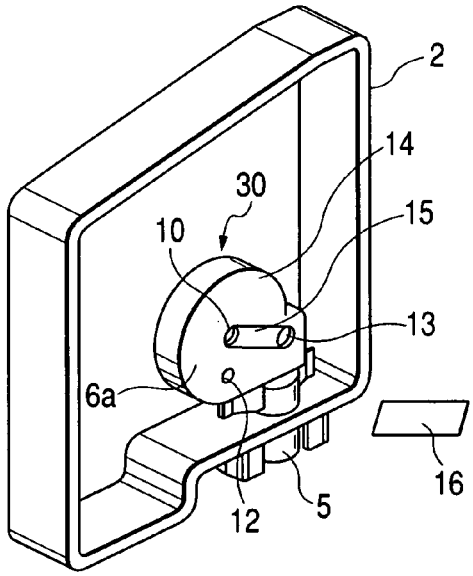
FIG. 2A is a perspective view showing the ink cartridge of FIG. 1 as viewed from the other surface side.
Figure 3:
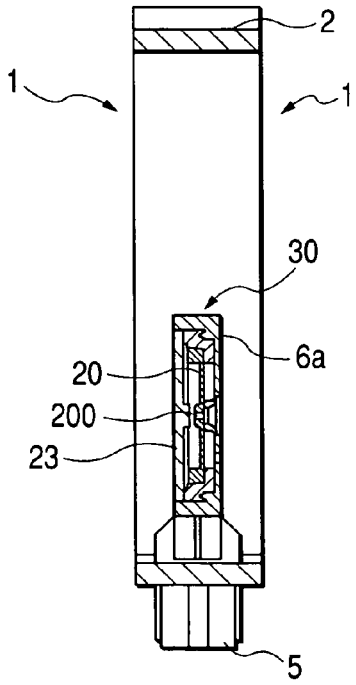
FIG. 3 is a sectional view of the ink cartridge, showing a sectional structure thereof in a vicinity of a negative pressure generating mechanism.

FIG. 1 and FIG. 2A are exploded perspective views showing an assembly of an ink cartridge according to an embodiment of the present invention, depicting the front and rear structures, respectively. FIG. 3 is a view showing a sectional structure thereof. The ink cartridge is in part defined by a frame member 2 having openings 1 on both sides thereof, and lid members 3 and 4 sealing the openings 1, respectively. The ink cartridge is formed with an ink supply port 5 at a leading end side in an insertion direction, e.g. at a bottom surface in this embodiment. The ink supply port according to the present invention encompasses a member or an opening portion to which, or into which, a connection member, such as a hollow needle or pipe, for detachable connection between the ink cartridge and a recording head provided on a carriage, is connectable or insertable.

An ink supply flow passage forming member 6, which is part of a negative pressure generating structure 30 is integrally formed in the vicinity of a portion of the frame member 2 facing the ink supply port 5 so that a portion of the ink supply flow passage forming member 6 located on one opening surface side of the frame member 2 constitutes an opening portion 7. Opening portion 7 is arranged to be in fluid communication with the ink supply port 5.

The ink supply flow passage forming member 6 is substantially divided into a valve member storing portion 8 for storing a substantially circular (disc-shaped) valve member (called also as an elastic member) 20, and a flow passage portion 9 for fluid communication with the ink supply portion 5. A protruding portion 11 having a first through-hole 10 serving as an ink outflow port is formed at a center of the valve member storing portion 8, and a second through-hole 12 serving as an ink inflow port is formed at a position offset from the protruding portion 11. The flow passage portion 9 is formed with a third through-hole 13 serving as an ink inflow port for communication with a front surface region of the valve member 20.

Figure 4A:
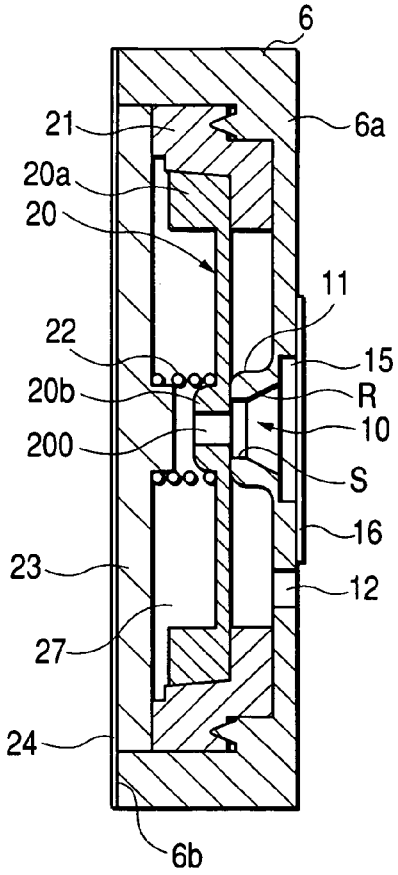
FIGS. 4A and 4B are enlarged sectional views, respectively showing a valve closed state and a valve open state of the negative pressure generating mechanism in the ink cartridge.
Figure 4B:
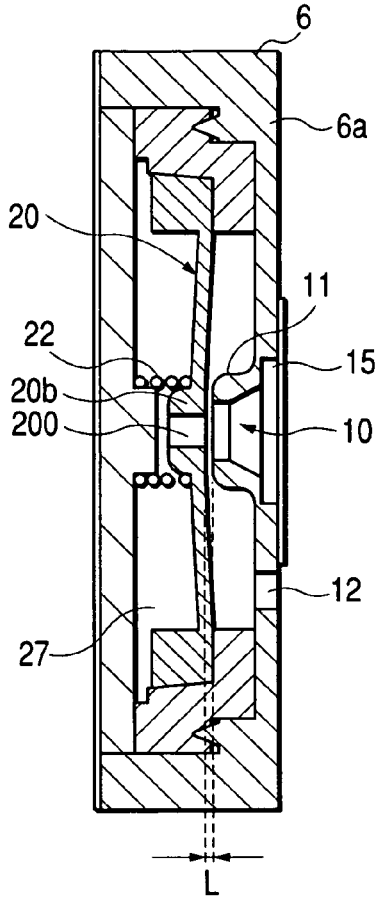
Figure 4C:
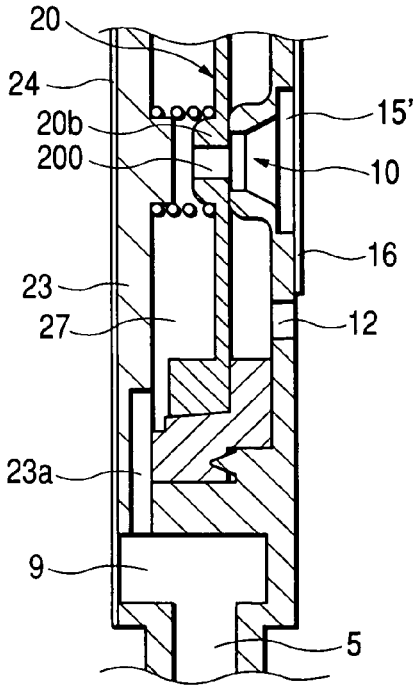
FIG. 4C is a sectional view showing an ink flow passage from the negative pressure generating mechanism to an ink supply port.

As shown in FIGS. 4A–C, the first through-hole 10 is formed to have a substantially cylindrical straight-sided portion S in an elastic member side, and a funnel-shaped portion R that flares outward moving along the through-hole 10 in the direction of ink flow as the ink moves toward the ink supply port 5. This funnel-shaped portion R is continuous to and downstream of the straight portion S. That is, the ink outflow side of the through-hole 10 flares outward. This structure ensures reliable sealing by the straight portion S, and lowers the flow passage resistance to fluid movement in the entire first through-hole 10 by the funnel-shaped portion R.

A recess portion 15 is formed in a surface 14 of a wall surface 6*a* defining the ink supply flow passage forming member 6 so as to connect the first through-hole 10 of the protruding portion 11 to the third through-hole 13 of the flow passage portion 9. A communication passage (hereafter, denoted by reference number 15') is defined by sealing the recess portion 15 with a covering film 16.

In the ink supply flow passage forming member 6 thus constructed, the elastically deformable valve member 20 is mounted via a position adjusting frame 21, as shown in FIG. 4. The valve member 20 is provided with a thick portion 20*a* along the circumference thereof, and thick portion 20*a* has a planar surface facing the protruding portion 11. A spring 22 for adjusting a differential pressure is positioned by a protruding portion 20*b* formed in the center of the valve member 20 and contacts the rear surface (back surface) of the valve member 20. Further, a holding member 23 seals the outside of the ink supply flow passage forming member 6 in water-tight fashion from an ink storing region while permitting communication between the flow passage portion 9 and the back surface of the valve member 20. Incidentally, in the depicted structure, the fit between the valve member 20 and the protruding portion 11 can be improved if the mating portions of these elements are made flat, since this will facilitate alignment, and avoid the need to take into account curvature of or irregularities in the abutting surfaces. The valve member 20 is formed with a through-hole 200 passing through the protruding portion 20*b*. The through-hole 200 is located within an area of the fit (sealing area) between the valve member 20 and the protruding portion 11, and is aligned and communicates with the through-hole 10.

To this end, in order to allow for such communication between the flow passage portion 9 and the back surface of the valve member 20, at least one, and possibly both, of recess portions 9*a* and 23*a* are formed in a region of the ink supply flow passage forming member 6 and the holding member 23 so as to face the flow passage portion 9.

The valve member 20 is preferably made of polymer material, such as an elastomer, which can be formed by injection molding, and which has elastic properties. The valve member 20 is provided with the spring-receiving protruding portion 20*b* at a region facing the protruding portion 11, i.e. at a central portion thereof A film 24 is joined or attached to a partition wall 6*b* which is part of the ink supply flow passage forming member 6 so as to cover the surface of the holding member 23 and seal the valve storing portion 8 and the flow passage portion 9, thereby ensuring reliable sealing and separation from the ink storing region.

Figure 2B:
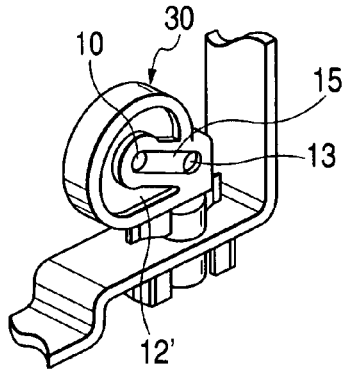
FIG. 2B is a prospective view showing another embodiment of a valve member storing portion.

In the embodiment described above, the second through-hole 12 is formed to be of substantially the same size as the first through-hole 10. However, the present invention is not so limited, and, as shown in FIG. 2B, the second through-hole 12 may be replaced with a window 12' formed as a consequence of removing a greater portion of the wall surface 6*a*, leaving behind enough material to provide a portion that is not deformed due to a pressing force of the spring 22 biasing the valve member 20 and which portion can permit the formation of the recess portion 15 serving as the communication passage. This arrangement thereby provides the same effects as the structure previously described.

In this embodiment, when the ink cartridge is mounted to a recording apparatus, and the pressure of the fluid at the ink supply port 5 side, i.e. the most downstream region from which ink is discharged from the ink cartridge, is reduced through ink consumption by a recording head or the like, the liquid pressure in the flow passage portion 9, the flow passage portion 15' formed by the recess portion 15 and the film 16 and a closed space (called also as a pressure operating compartment) 27 behind the valve member 20 communicating therewith via a flow passage formed by the recess portion 23*a* is also lowered, so that the reduced pressure acts on the surface which is also pressed with a biasing force by the spring 22. The closed space 27 is in fluid communication with the ink supply port 5 via the passage formed by the recess portion 23*a* and the flow passage 9. The closed space 27 is also in fluid communication with the ink supply port 5 via the through-hole 200, the through-hole 10, the flow passage 15' and the flow passage 9. However, in the case where the negative pressure of the fluid in the ink supply port 5 does not reach a predetermined valve, the valve member 20 maintains a sealed state of the first through-hole 10 and the through-hole 200 as it is subjected to the biasing force of the spring 22.

Figure 5A:
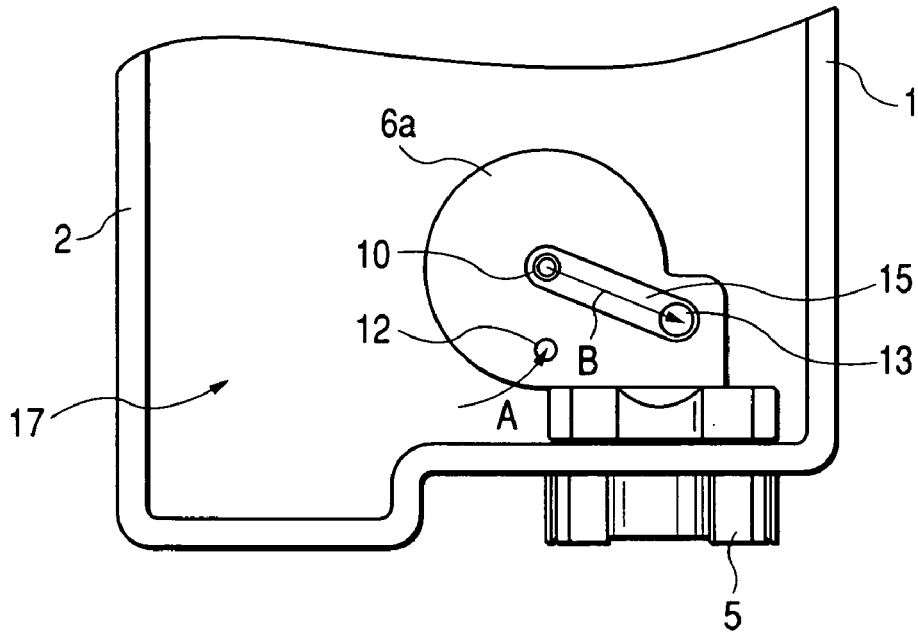
FIGS. 5A and 5B show the flow of ink in the ink cartridge.
Figure 5B:
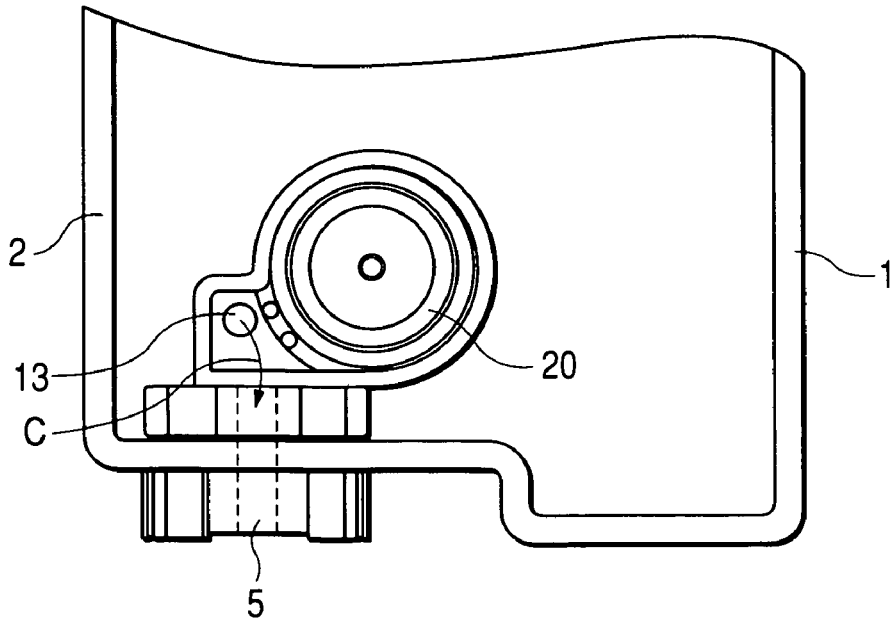

FIG. 4C is a sectional view taken, in part, through the flow passage portion 9 of the negative pressure generating structure 30. When the negative pressure is decreased so that the correspondingly-generated force is less than the force applied by the spring 22 and the inherent rigidity of the valve member 20, the negative pressure at the ink supply port 5 acts on the pressure operating compartment 27 of the valve member 20, which is in communication with the ink supply port through the recess portion 23*a* or 9*a* (FIG. 4C) and the through-hole 200, etc. Accordingly, the valve member 20 experiences a sufficient force from the pressure differential to be moved against the biasing force of the spring 22, and so is separated from the protruding portion 11 (FIG. 4B), allowing ink in the ink storing chamber 17 to flow into the communication passage 15' via the second through-hole 12 (this is depicted by arrow A in FIG. 5A) and the first through-hole 10 of the protruding portion 11. The ink flowing into the communication passage 15' flows via the third through-hole 13 (depicted by arrow B in FIG. 5A) and the flow passage portion 9 into the ink supply port 5 (depicted by arrow C in FIG. 5B). Concurrently, ink in the ink storage chamber 17 is allowed to flow into the pressure operating compartment 27 via the through-hole 12 and the through-hole 200. The ink flowing into the compartment 27 flows via the recessed portion 23*a*, 9*a* and the flow passage portion 9 into the ink supply port 5.

When a predetermined quantity of ink flows into the ink supply port 5 in this fashion to increase the pressure at the back surface of the valve member 20, the change in the pressure differential across the valve member 20 causes the valve member 20 to be elastically contacted with the protruding portion 11 under the biasing force of the spring 22, and so seal the through-hole 10 and the through-hole 200 (FIG. 4A).

Thereafter, this operation is repeated to supply ink into the recording head, while maintaining the pressure at the ink supply port side at the predetermined negative pressure.

It should be noted that this regulation of the ink flow takes place automatically in response to the consumption of ink from the ink supply port. This avoids the need to have a dedicated external control system which periodically opens and closes the valve to regulate ink flow from the ink container to the ink supply port, and so simplifies and improves the ink cartridge construction.

Figure 6A:
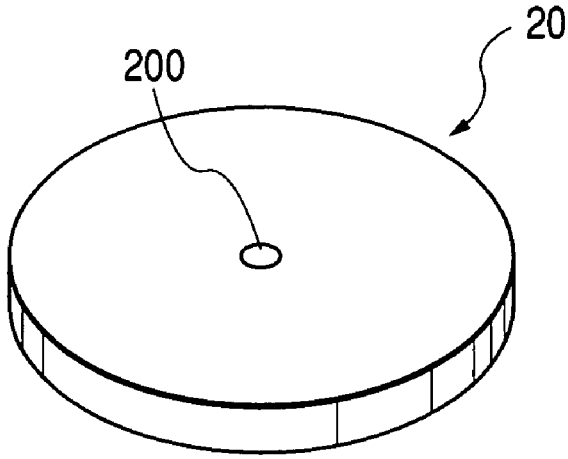
FIGS. 6A and 6B are views showing different embodiments of a valve member.
Figure 6B:
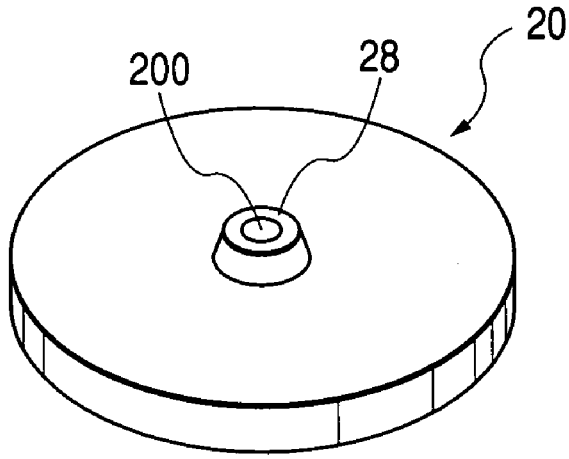

As shown in FIG. 6A, the sealing side of the valve member according to the present invention is formed as the planar surface. Alternatively, as shown in FIG. 6B, a protruding portion 28 may be formed to have the through-hole 200 passing therethrough.

In the embodiment described above, the valve member and the frame member are constructed as discrete members. However, they may be formed as a one-piece member through coinjection molding with respective appropriate materials.

Figure 7:
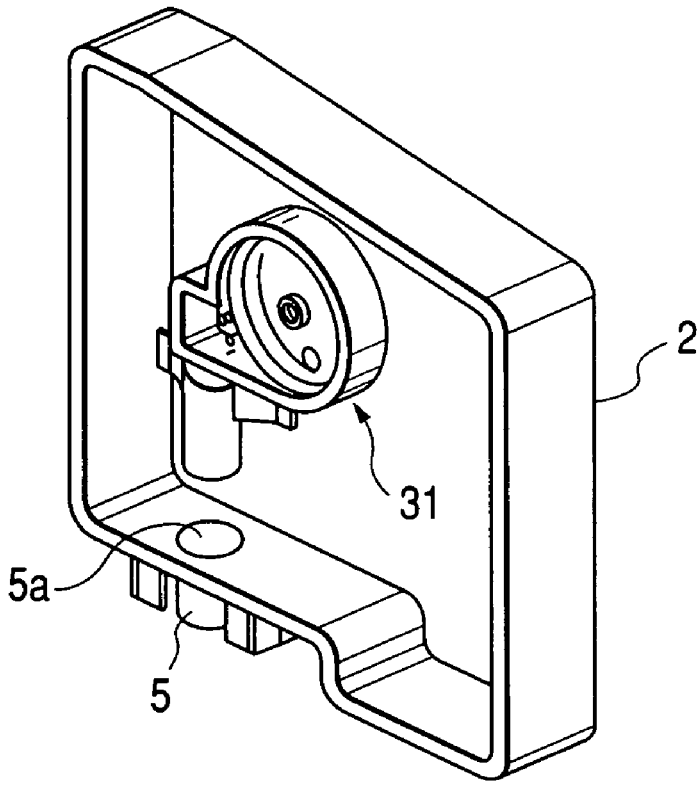
FIG. 7 shows another embodiment in which a member defining a region where the negative pressure generating mechanism is installed is formed as a discrete member.

In the embodiment described above, the wall defining the region where the negative pressure generating mechanism is installed is formed to be integral with the member defining the ink storing region. Alternatively, as shown in FIG. 7, the member defining the region where the negative pressure generating mechanism is installed may be constructed as a discrete member 31, which is inserted into an upstream side opening 5*a* of the ink supply port 5.

Next, another embodiment of the present invention will be discussed.

Figure 8:
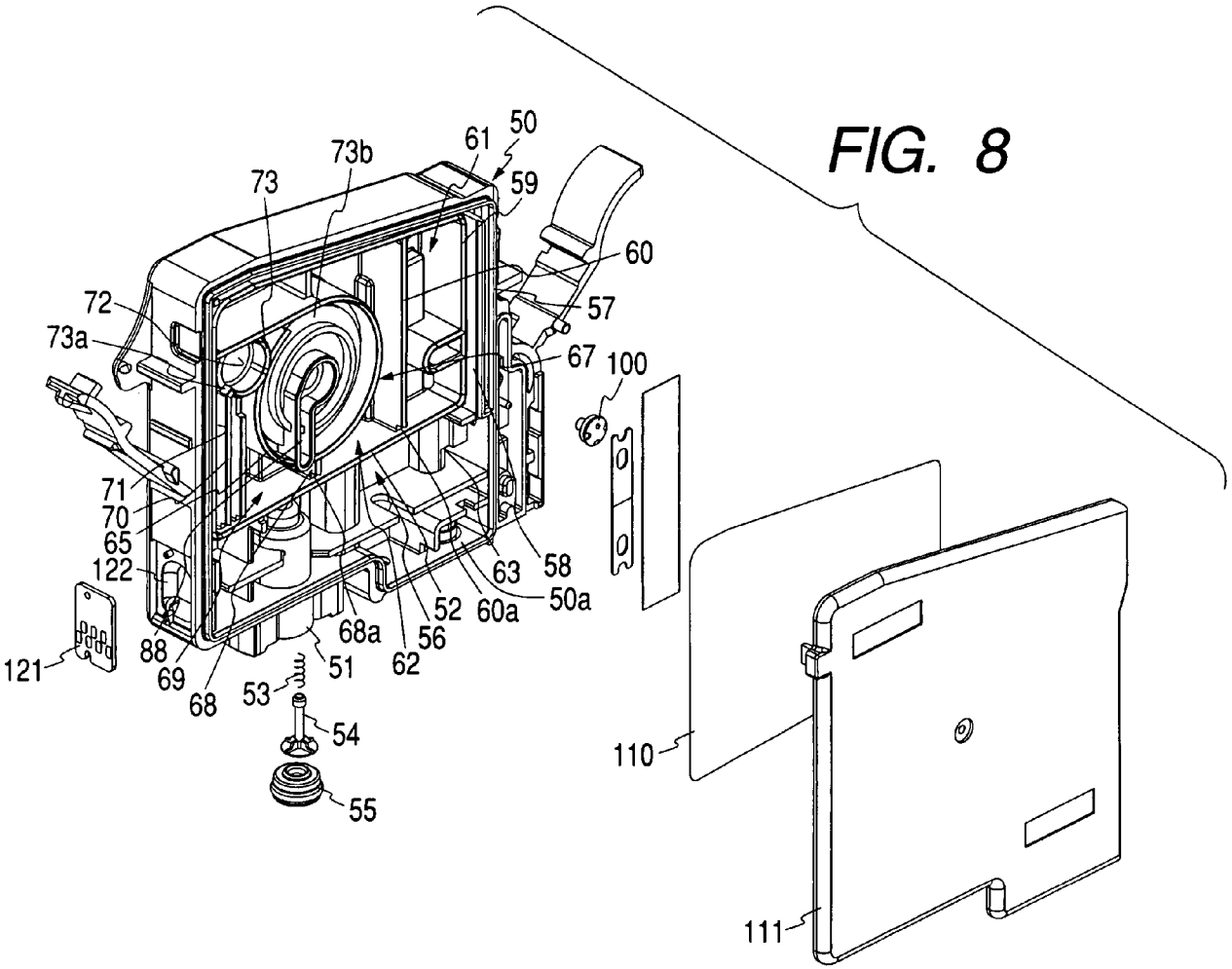
FIG. 8 is a perspective view showing the assembly of an ink cartridge according to another embodiment of the present invention, and in particular showing a structure of an opening side of a container main body.
Figure 12:
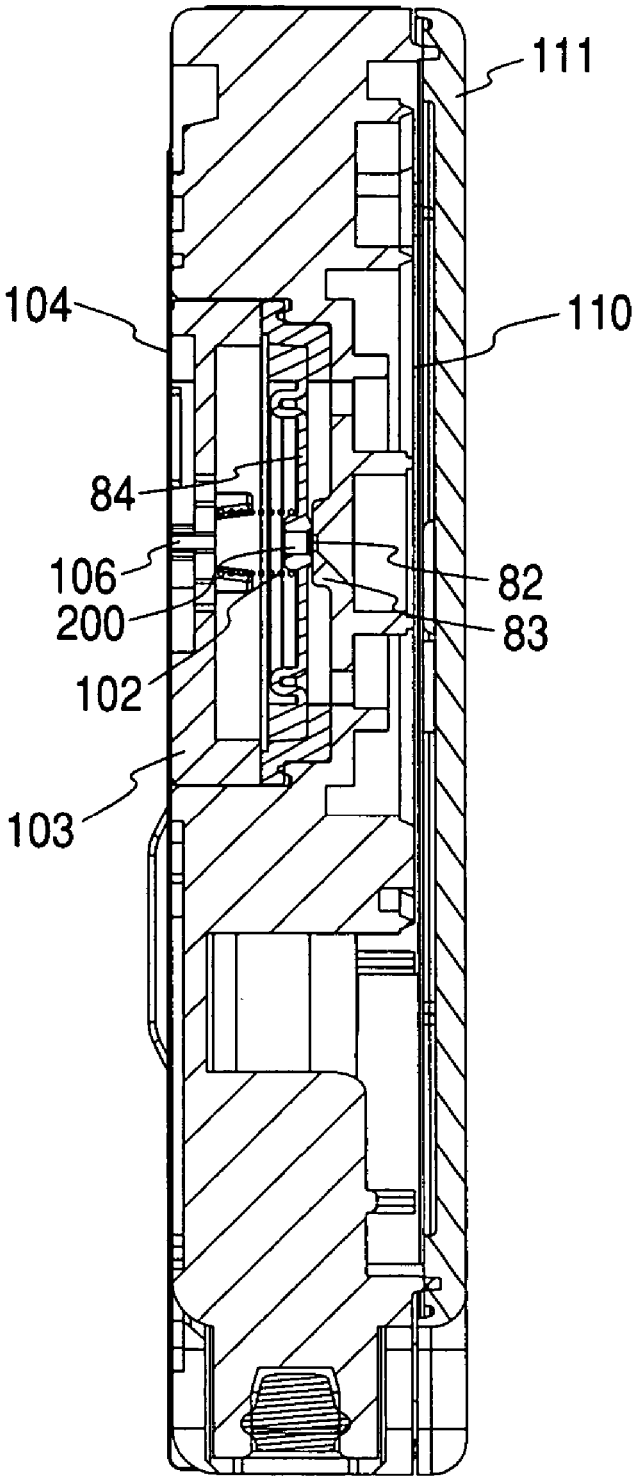
FIG. 12 is a sectional view showing a region of the container main body, where a negative pressure generating mechanism is assembled.
Figure 13:
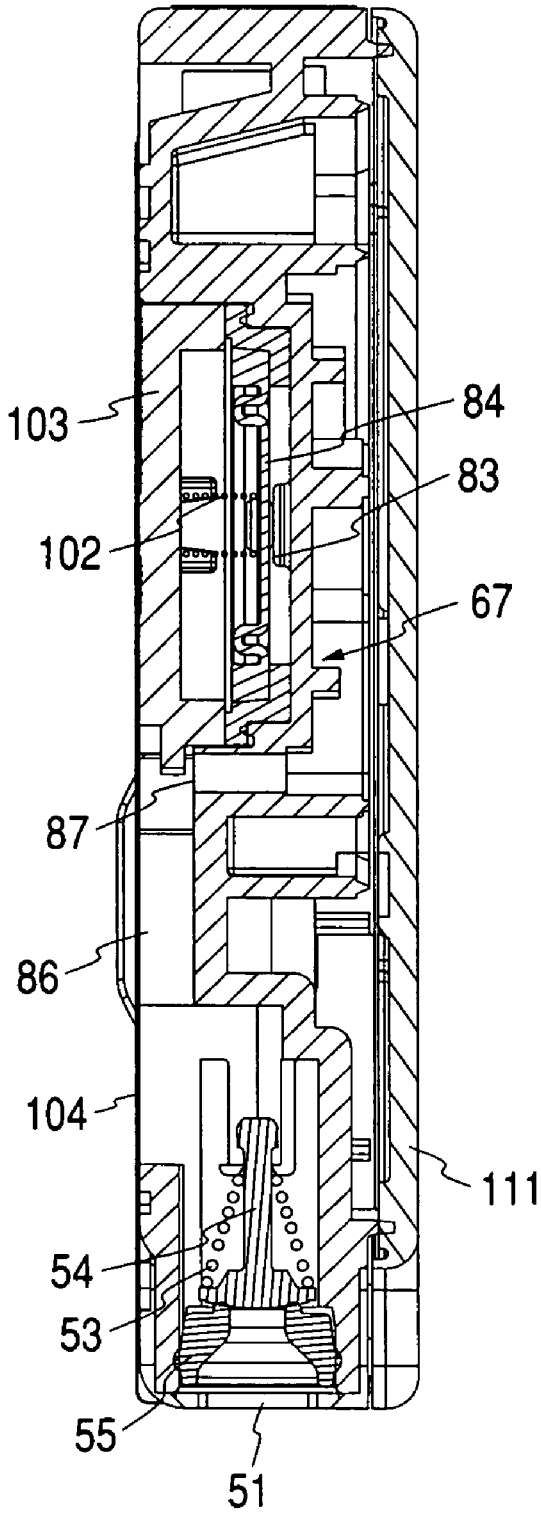
FIG. 13 is a sectional view showing a flow passage part of the container main body from the region, into which the negative pressure generating mechanism is assembled, to an ink supply port.
Figure 14:
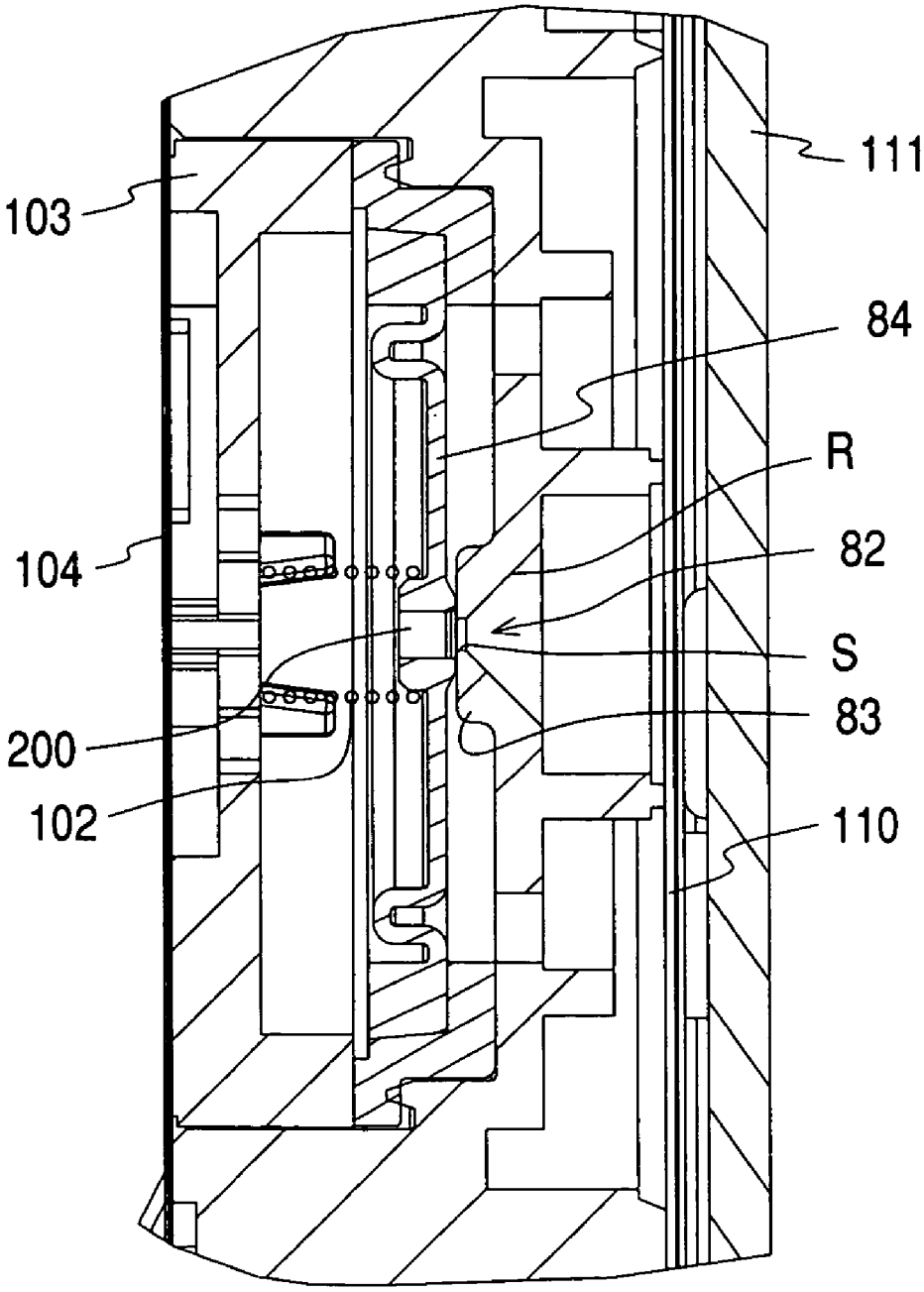
FIG. 14 is an enlarged sectional view showing the region into which the negative pressure generating mechanism is assembled.

FIGS. 8 to 11 show the front and rear structures of an ink cartridge with an opening closure member removed. FIGS. 12 and 13 show details of a negative pressure generating mechanism that is seen in cross-section. FIG. 14 shows details of a negative pressure generating mechanism that is seen in enlarged cross-section. With reference now to FIG. 8, the interior of a container main body 50 forming an ink storage region is vertically divided by a wall 52 extending substantially in a horizontal direction, and, more specifically, extending so that an ink supply port 51 side of the wall 52 is located slightly downward. A valve member 54, a sealing member 55 and a spring 53 are stored in the ink supply port 51, so that in the state where the ink cartridge is not mounted upon a recording apparatus main body, the valve member 54 is kept in elastic contact with the sealing member 55 by the spring 53 to sealingly close the ink supply port 51.

The lower region below the wall 52 is formed with a first ink storage chamber 56, and the upper region above the wall 52 is defined by a frame 59 having the wall 52 as a bottom surface, and that is separated from a wall 57 of the container main body 50 by a clearance, preferably constant, to form an atmosphere communication passage 58. The interior region of the frame 59 is further divided by a vertical wall 60 formed at its bottom with a communication port 60*a*, so that one of the divided regions (i.e. a right side region in the drawing) serves as a second ink storage chamber 61, and the other region serves as the third ink storage chamber 62.

A suction flow passage 63 is formed in a region opposing the first ink storage chamber 56 so as to connect the second ink storage chamber 61 and a bottom surface 50*a* of the container main body 50. The suction flow passage 63 is constructed by forming a recessed portion 64 (FIG. 9) in the front surface of the container main body 50 and sealing this recessed portion 64 with an air impermeable film 104, to be described later in greater detail.

In the third ink storage chamber 62, an ink supply flow passage forming member 67 is constructed by forming an annular frame wall 65 flush with the frame 59, and a planar surface 66 dividing the interior of the annular frame wall into front and rear sides. A vertical wall 68 is formed between the lower portion of the frame wall 65 and the wall 52 to define a fourth ink storage chamber 69. A recessed portion 68*a* for communication is formed in the lower portion of the wall 68.

A partition wall 70 is provided between the fourth ink storage chamber 69 and the frame portion 59 to form an ink flow passage 71. The upper portion of the ink flow passage 71 communicates with the front surface side of the container main body 50 via a through-hole 72 that can serves as a filter chamber, if desired.

The through-hole 72 is defined by a wall 73 continuous with the wall 70 such that the through-hole 72 communicates with the upper end of the ink flow passage 71 via a recessed portion 73*a*. The through-hole 72 also communicates via a preferably tear-drop-shaped recessed portion 74 formed in the front surface side, and a communication port 73*b* with the interior of the frame wall 65.

Figure 9:
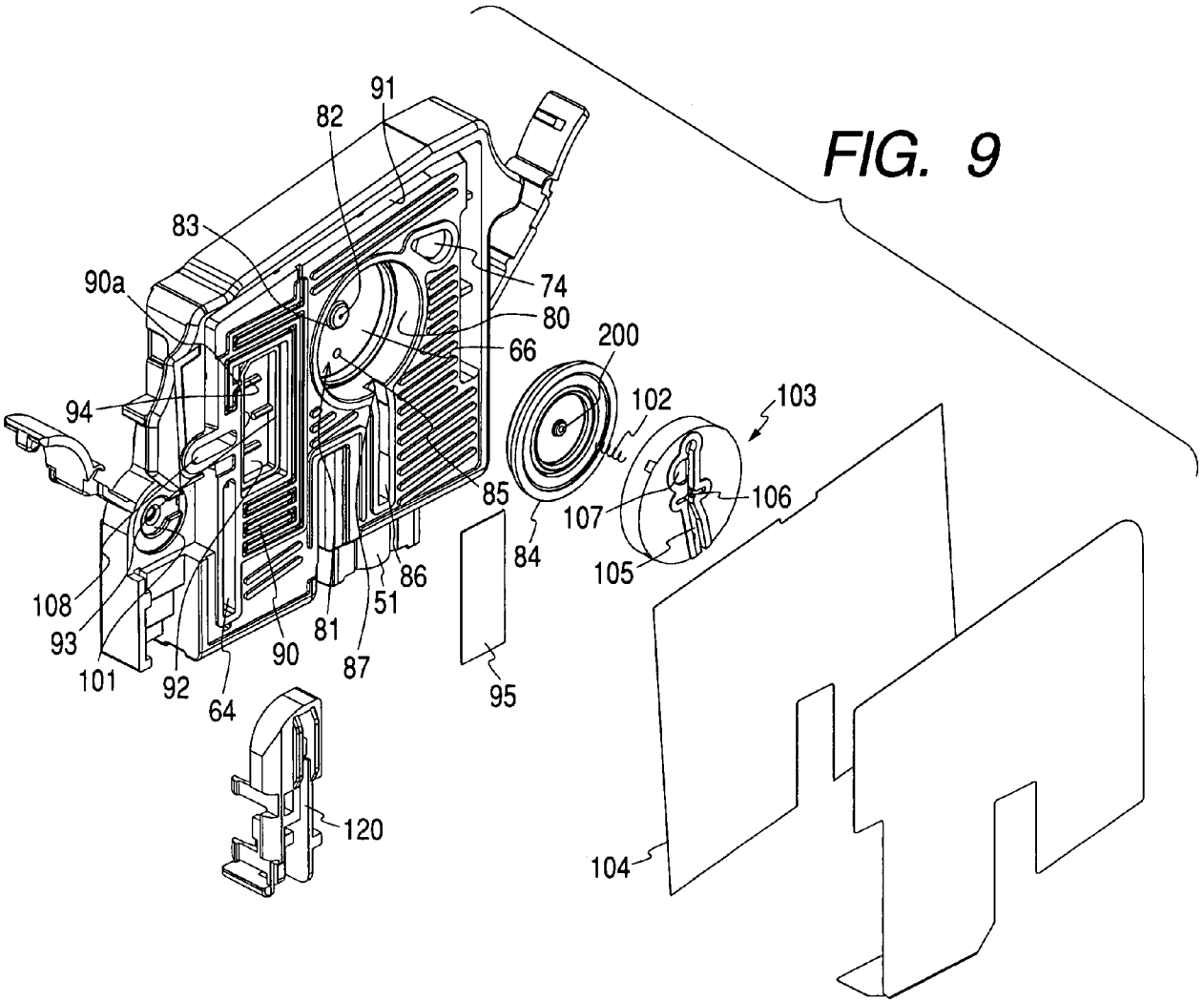
FIG. 9 is a perspective view showing the assembly of the ink cartridge, particularly showing a structure of a front surface side thereof.

As shown in FIG. 9, the lower portion of the ink supply flow passage forming member 67 is connected to the ink supply port 51 via a flow passage constructed from a recessed portion 86 formed in the surface of the container main body 50 and an air impermeable film 104 sealing this recessed portion 86. The ink supply flow passage forming member 67 has the planar surface 66 and an annular wall 80 that are located in the front surface side of the container main body 50 and that are opposite from the ink storage region, to thereby define a valve member storage portion 81. The planar surface 66 is formed to have at its approximate center a protruding portion 83 having a through-hole 82. The protruding portion 83 serves as a sealing portion, and is located in a region opposing a through-hole 200 of the elastic valve member 84. The planar surface 66 is also formed, at offset positions from the protruding portion 83, with a communication passage 85 communicating with the front surface of the valve member 84.

The through-hole 82, in a manner similar to that shown in FIG. 4A, is constructed by a substantially cylindrical straight portion S located on the elastic member side, and a funnel-shaped portion R that is gradually enlarged in the direction of ink flow toward the ink supply port 51 and which is continuous to and downstream of the straight portion S (that is, the ink outflow side of the through-hole 82 flares outward), whereby a reliable seal is ensured by the straight portion S, while the flow passage resistance in the entire through-hole 82 is reduced by the funnel-shaped portion R.

A notched portion 87 is formed in the vicinity of the lower end of the wall 80, which is connected to the recessed portion 86 extending downwardly toward the ink supply port 51. The depth of this notched portion 87 is chosen so that the notched portion 87 communicates only with a back surface side of the valve member 84 when the valve member 84 is installed. A wall 88 is formed in the rear surface side opposing the through-hole 82, i.e. in the upper ink storage region, and this wall which extends toward the upper end of the recessed portion 86 while escaping from the communication passage 85 and also partitions a space from the surrounding region, so that the space is connected via through-hole 89 at a lower end of the wall 88 to the upper end region of the recessed portion 86.

The front surface of the container main body 50 is formed with a narrow groove 90 that meanders to increase the flow passage resistance as much as possible, a wide groove 91 around the narrow groove 90, and a rectangular recessed portion 92 located in a region opposing the second ink storage chamber 61. A frame portion 93 is formed in the rectangular recessed portion 92 at a location slightly lower than an opening edge of the recessed portion 92, and ribs 94 are formed inside the frame portion 93 to be separated one from another. An ink-repellent air permeable film 95 is stretched over and adhered to the frame portion 93 to define an atmosphere communication chamber.

Figure 10:
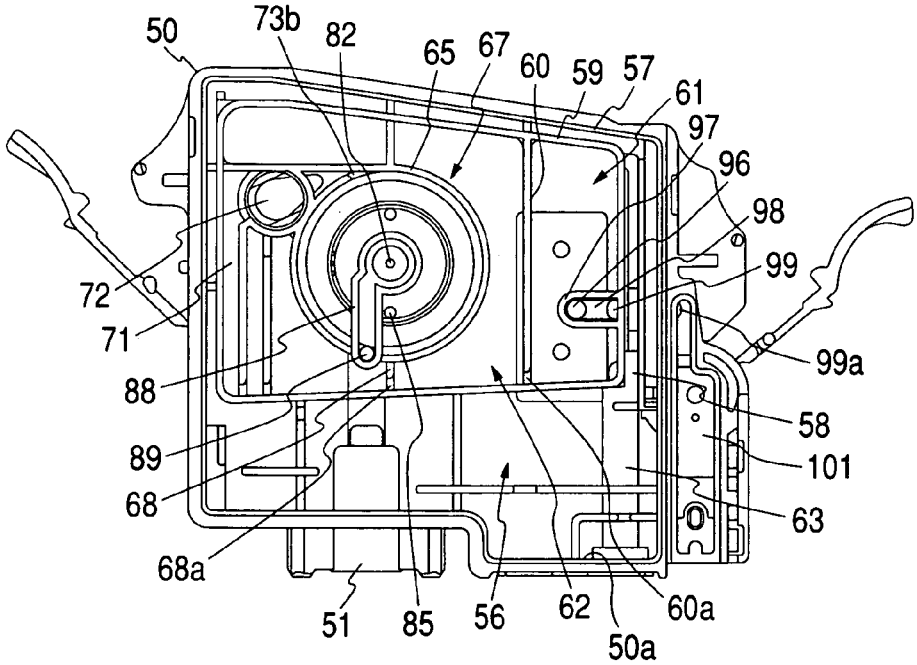
FIG. 10 is a front view showing the opening side of the container main body.
Figure 11:
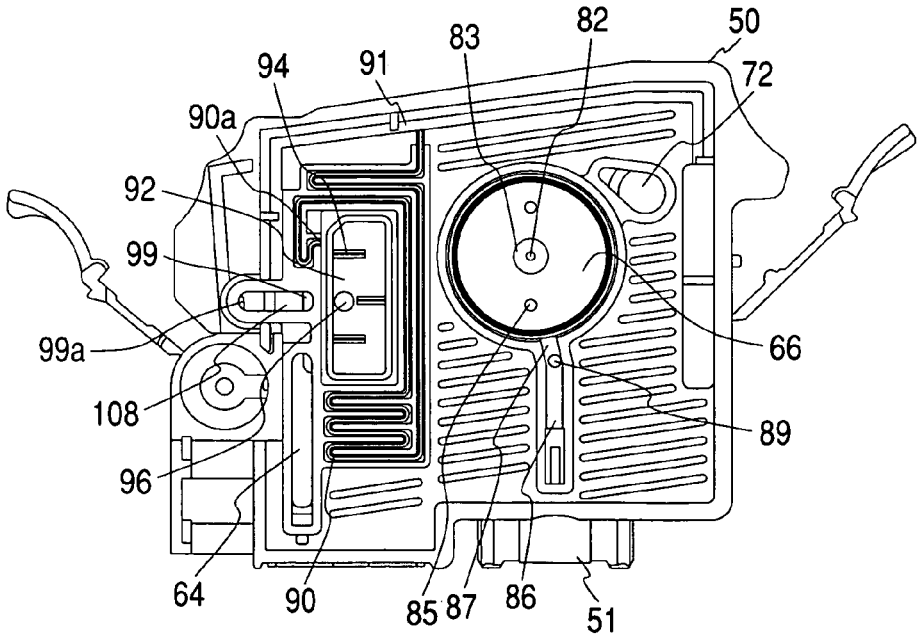
FIG. 11 is a front view showing a bottom portion side of the container main body.

As seen in FIGS. 10 and 11, a through-hole 96 is formed in the bottom surface of the recessed portion 92 to communicate with a slender region 98 partitioned by a wall 97 formed in the interior of the second ink storage chamber 61. The other end of the region 98 communicates via a through-hole 99 formed in the region 98, a groove 108 formed in the front surface of the container main body 50, and a through-hole 99*a* with a valve storage chamber 101 containing therein an atmosphere communication valve 100 that opens when the ink cartridge is mounted on a recording apparatus. The surface side region of the recessed portion 92 with respect to the air permeable film 95 communicates with one end 90*a* of the narrow groove 90.

The valve storage portion 81 of the container main body 50 is constructed in a manner similar to that for the aforementioned embodiment discussed in connection with FIG. 1. As shown in FIG. 9, the valve member 84 and the spring 102 are installed in like fashion, the holding member 103 is mounted in the same manner, and the film 104 is attached to cover the front surface of the container main body 50 in the same way. The holding member 103 is formed with a groove 105 communicating with the notched portion 87, and flow passages 106 and 107 communicating with the back surface of the valve member 84.

Consequently, the recessed portions 74, 86 and 105 together with the film 104 form the ink flow passage, and the narrow grooves 90 and 91 and the recessed portion 92 and 108 together with the film form the capillary and the atmosphere communication passage.

At the opening side of the container main body 50, openings of the upper portion ink storage chambers 61, 62 and 69 and the opening of the ink supply flow passage forming member 67 are sealed by a film 110 to separate these regions from the lower portion ink storage chamber 56 and the atmosphere communication passage 58. Thereafter, the lid member 111 is sealingly attached to the container main body 50 to complete the lower portion ink storage chamber 56.

In addition, as shown in FIGS. 8 and 9, reference numeral 120 in the drawings designates an identification piece that is used to prevent erroneous mounting of the ink cartridge, and reference numeral 121 designates a memory device that stores ink information, etc. therein, and which is mounted in a recessed portion 122 of the container main body.

When the ink cartridge thus constructed is mounted on an ink supply needle communicating with a recording head, the valve member 54 is moved backward by the ink supply needle against the biasing force exerted by the spring 53, to thereby open the ink supply port 51. In this state, as the pressure in the ink supply port 51 is lowered as a consequence of ink consumption by the recording head as it effects recording, etc., the reduced pressure acts on the flow passage formed by the recessed portion 86 and the film 104 and on the back surface of the valve member 84 via the notched portion 87, i.e. on the surface where the valve member 84 receives the pressing force of the spring 102. If the pressure in the ink supply port 51 is not reduced to less than a predetermined value sufficient to move the valve member 84, the valve member 84 remains pressed in elastic contact against the protruding portion 83 by the biasing force exerted by the spring 102 to thereby keep closed the through-hole 82. Therefore, ink does not flow from the ink storage chamber to the ink supply port 51.

When the pressure in the ink supply port 51 (i.e. in a flow passage of the member or opening portion to which or into which the connection member, such as the hollow needle or pipe, for detachable connection between the ink cartridge and the recording head provided on the carriage is connected or inserted) is reduced to the predetermined value as a consequence of continued ink consumption by the recording head, the pressure acting on the back surface of the valve member 84 via the flow passage as described above becomes sufficient to overcome the force exerted by spring 102, and therefore the valve member 84 is separated from the protruding portion 83. Consequently, ink flows from the communication passages 85 into a region between the valve member 84 and the planar surface 66 so that the ink flows from the through-hole 82 of the protruding portion 83 via the passage formed by the recessed portion (wall) 88 and the film 110, the through-hole 89, the flow passage formed between the recessed portion 86 and the film 104, and the ink supply port 51 into the recording head of the recording apparatus. Concurrently, ink flowing into the region between the valve member 84 and the planar surface 66 also flows from the through-hole 200 of the valve member 84 via the passage 106, the passage defined by the recessed portion 105 and the film 104, the notched portion 87, the passage defined by the recessed portion 86 and the film 104 and the ink supply port 51 into the recording head of the recording apparatus. That is, ink flows from both sides of the valve member 84 into the ink supply port 51.

When the pressure on the back surface of the valve member 84 is increased as a result of a predetermined amount of ink flowing into the back surface side of the valve member 84, the valve member 84 is again urged into contact with the protruding portion 83 by the biasing force of the spring 102 to seal the through-hole 82 and the through-hole 200 from the region between the valve member 84 and the planar surface 66, to thereby block the flow passage. Accordingly, it is possible to maintain the liquid in the ink supply port 51 at a negative pressure sufficient to prevent ink leakage from the recording head, while enabling supply of ink to the recording head.

As ink is consumed, the ink in the fourth ink storage chamber 69 flows via the flow passage 71 and the through-hole 72 into the front surface side of the valve member 84. Further, since the only the first ink storage chamber 56 is opened to the atmosphere, ink in the third ink storage chamber 62 flows into the fourth ink storage chamber 69 via the recessed portion 68*a* as the ink in the fourth ink storage chamber 69 is consumed, and ink in the second ink storage chamber 59 flows into the third ink storage chamber 62 via the recessed portion 60*a* as ink in the third ink storage chamber 62 is consumed. Ink in the first ink storage chamber 56 flows into the second ink storage chamber 61 via the suction flow passage 63 as ink in the second ink storage chamber 61 is consumed. Therefore, the most upstream side ink storage chambers are sequentially emptied earlier, so that ink in the first ink storage chamber 56 is consumed first, then ink in the second ink storage chamber 61 is consumed, and so on.

Figure 15:
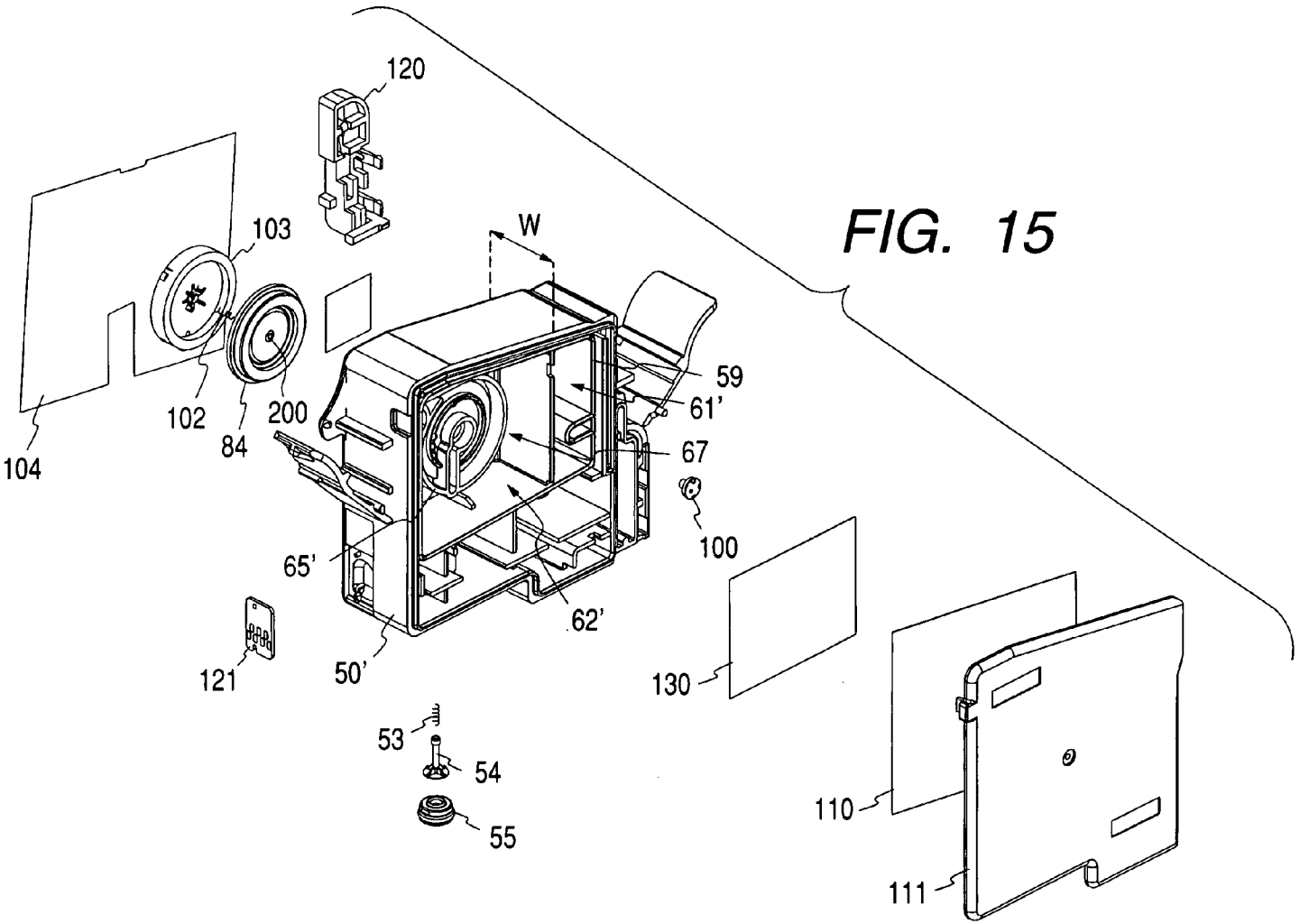
FIG. 15 is an exploded perspective view showing the assembly of an ink cartridge according to another embodiment of the present invention, particularly showing an opening side of a container main body.

FIG. 15 shows another embodiment in which the ink capacity of the aforementioned ink cartridge is increased. The container main body 50' of this embodiment has the same structure as the container main body 50 of the aforementioned embodiment with the exception that the width W of the container main body 50' is made larger.

Figure 16:
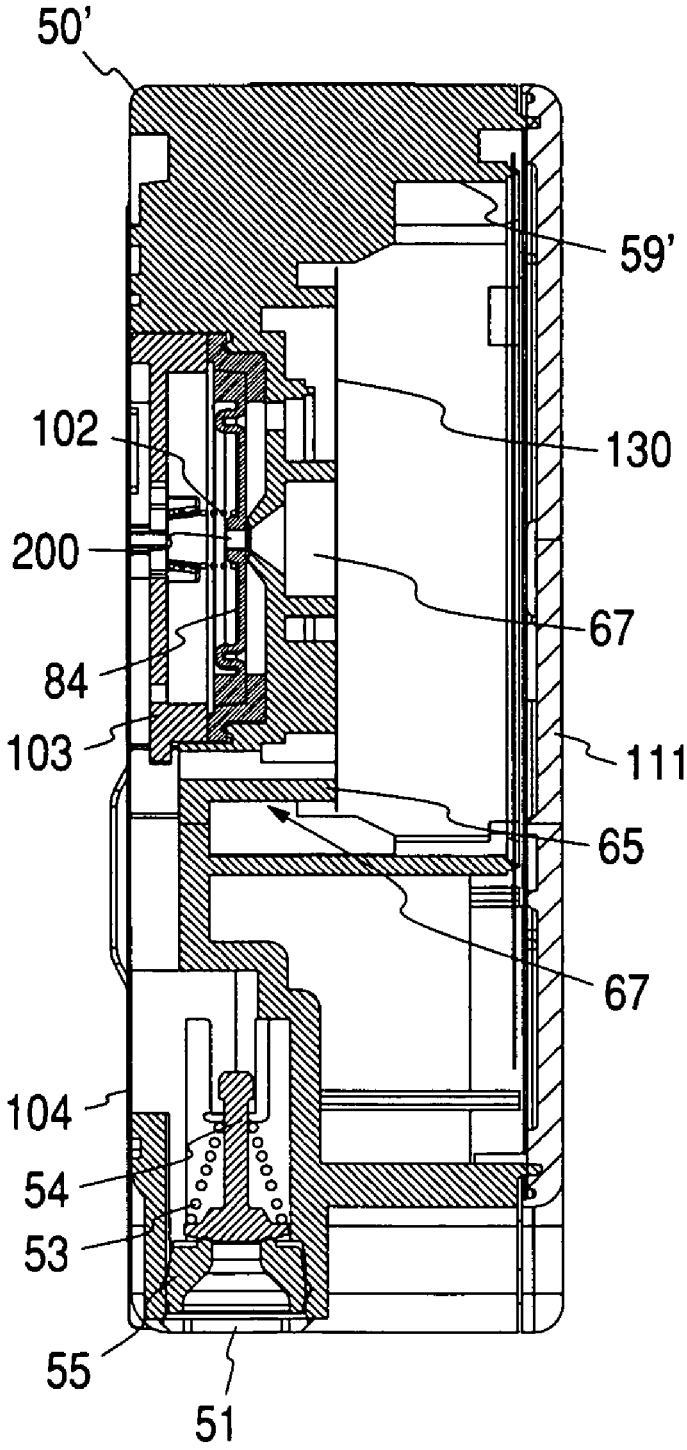
FIG. 16 is a sectional view showing a region of the container main body into which a negative pressure generating mechanism is assembled.

As a consequence of this modification, since the height of the partition wall 65 of the ink supply flow passage forming member 67 differs from that of the frame 59', a third film 130 is used to seal the opening portion of the partition wall 65 of the ink supply flow passage forming member 67 as shown in FIG. 16.

Figure 17:
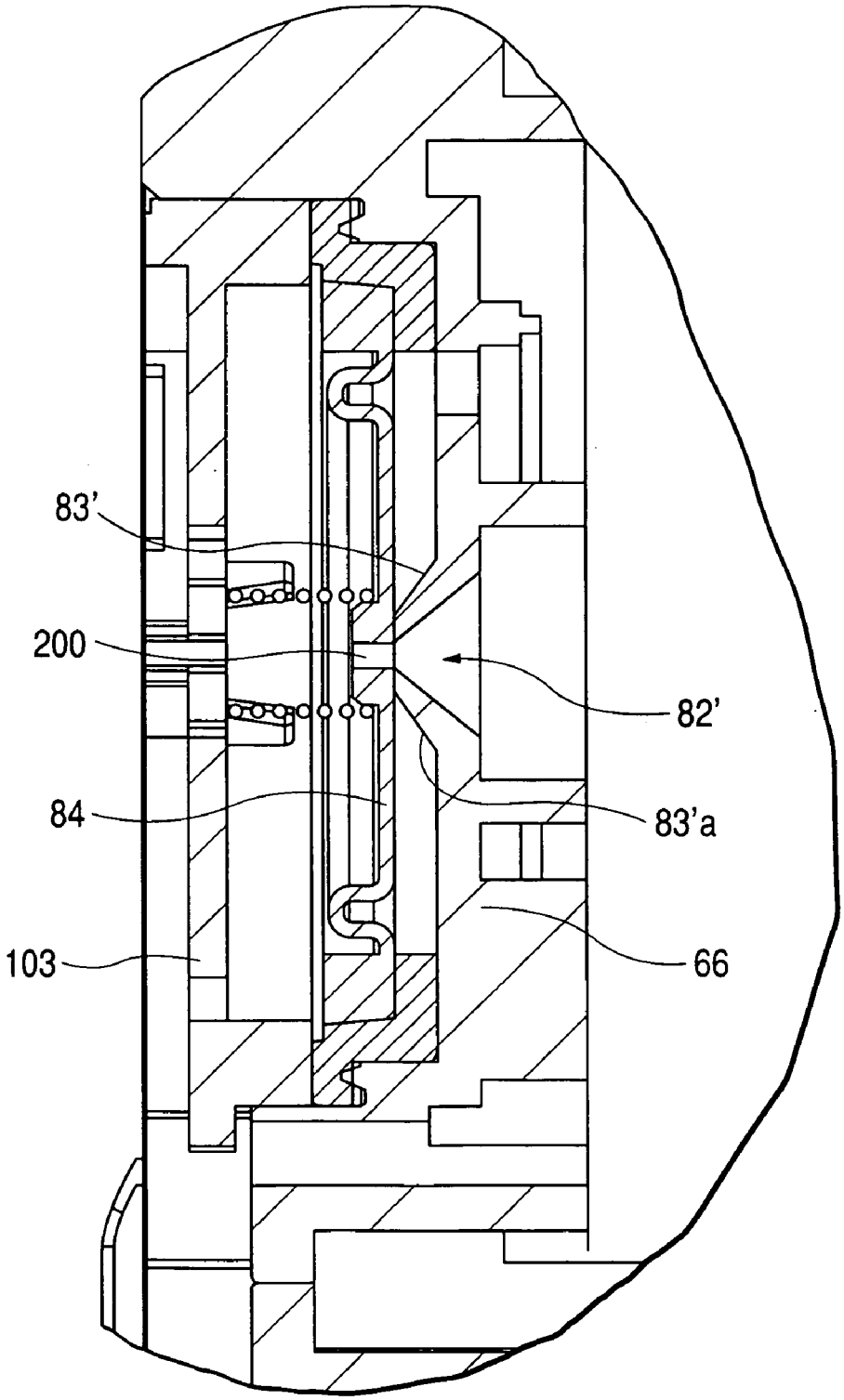
FIG. 17 is an enlarged sectional view showing the region into which the negative pressure generating mechanism is assembled in an ink cartridge according to another embodiment of the present invention.

In the embodiment shown in FIGS. 8 to 14, the front surface of the protruding portion 83 of the ink supply flow passage forming member 67 is several times as large as the diameter of the through-hole 82. As shown in FIGS. 16 and 17, the through-hole 82' and the protruding portion 83' may be each formed with a conical shape, when seen in section, to decrease the flow passage resistance by the enlarging diameter of the through-hole 82' as well as to increase a flow passage region between the valve member 84 and a wall 83*a*' in the vicinity of the through-hole 82', to thereby further decrease the flow passage resistance.

Further, as shown in FIG. 17, the surface of the valve member 84, i.e. the sealing side of the valve member 84, may be formed as a planar surface similarly to the embodiment shown in FIG. 6A.

Figure 18B:
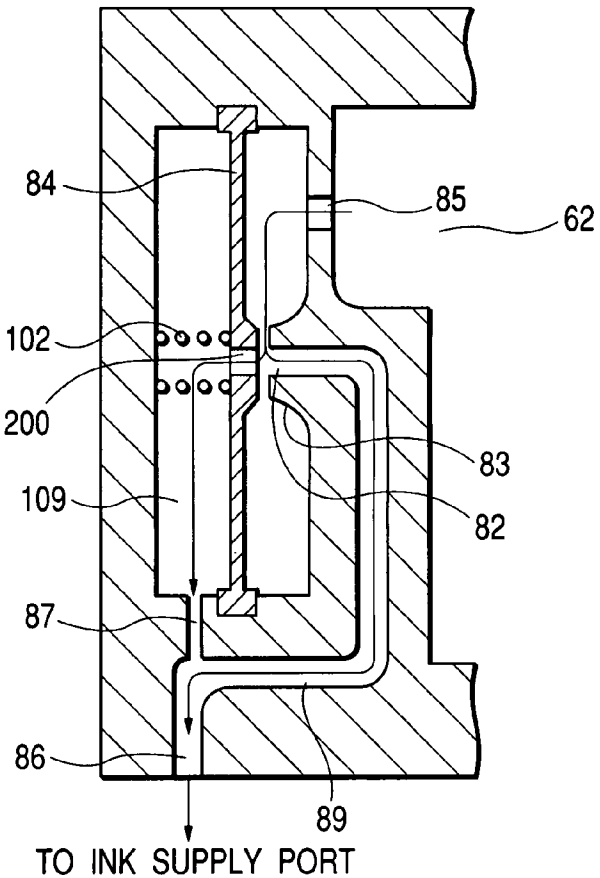
FIGS. 18A and 18B are schematic views, respectively showing a valve closed state and a valve open state of a flow path structure a negative pressure generating mechanism in an ink cartridge according to the present invention.
Figure 18A:
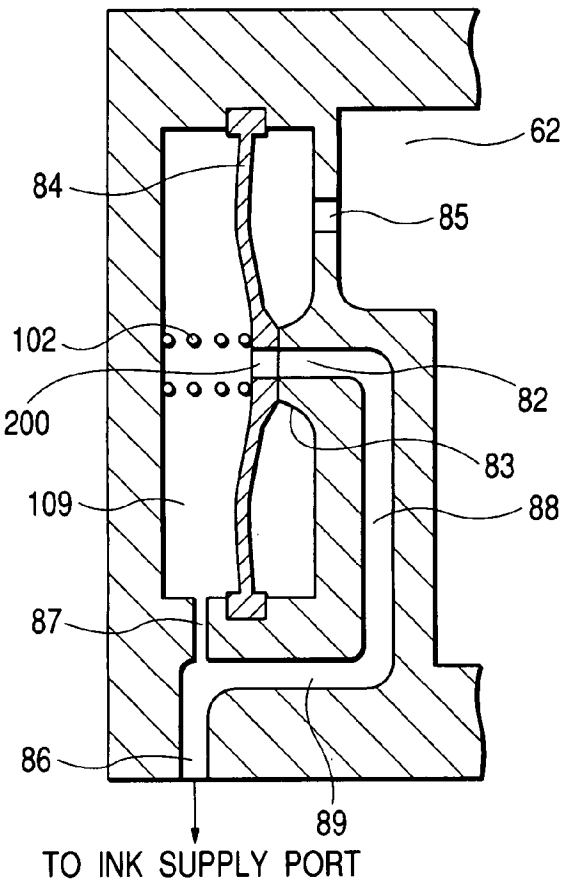

Next, the operation of the negative pressure generating structure of the ink cartridge as described previously with reference to FIGS. 8 to 14 will be further discussed with reference to FIGS. 18A and 18B, which are schematic diagrams depicting additional simplified structure in accordance with the present invention. FIGS. 18A and 18B are schematic diagrams respectively showing a valve closed state and a valve open state with the negative pressure generating structure simplified. For clarity in explanation and in correspondence with the structure of the aforementioned negative pressure generating structure, the same reference numerals are used as were employed in connection with the embodiment shown in FIGS. 8 to 14.

In the valve closed state shown in FIG. 18A, the valve member 84 closes the through-hole 82 in response to the biasing force applied thereto by the spring 102, and so the flow of ink from the ink chamber 62 to the ink supply port is blocked. In this state, as when the ink is consumed by the recording head, the pressure in the ink supply port side is correspondingly reduced, so that the thus reduced pressure acts on the valve member 84 via the communication passage 87 and the flow passage 88.

In this embodiment, the back surface side of the valve member 84 communicating with the communication passage 87 faces a compartment 109 that is located between the valve member 84 and the communication passage 87 and which compartment 109 is open for fluid communication to an exterior via the communication passage 87. The compartment 109 also communicates with the flow passage 88 via the through-holes 82 and 200. That is, the compartment 109 serves as the pressure operating compartment for transmitting the pressure change of the ink supply port to the back surface of the valve member 84.

Accordingly, the back surface of the valve member 84 receives the reduced pressure of the ink supply port side over an open wide area. For this reason, due to the difference in pressure between the pressure receiving areas on the front and back surfaces of the valve member 84, a force is exerted in a direction so as to compress the spring 102. When the pressure at the ink supply port side is reduced below a pressure set by the spring 102, the valve member 84 is separated from the protruding portion 83 as shown in FIG. 18B to open the openings 82 and 200, whereby the ink in the ink storing chamber 62 flows from the communication passage 85 via the flow passage 88 and the flow passage 87 into the recording head. That is, the ink in the ink storage chamber 62 flows from both sides of the valve member 84 into the recording head.

Therefore, any pressure change at the ink supply port side acts surely on the back surface of the valve member 84 via the ink to prevent the supply of ink from stopping. A large amount of ink can be supplied to the recording head.

Figure 19B:
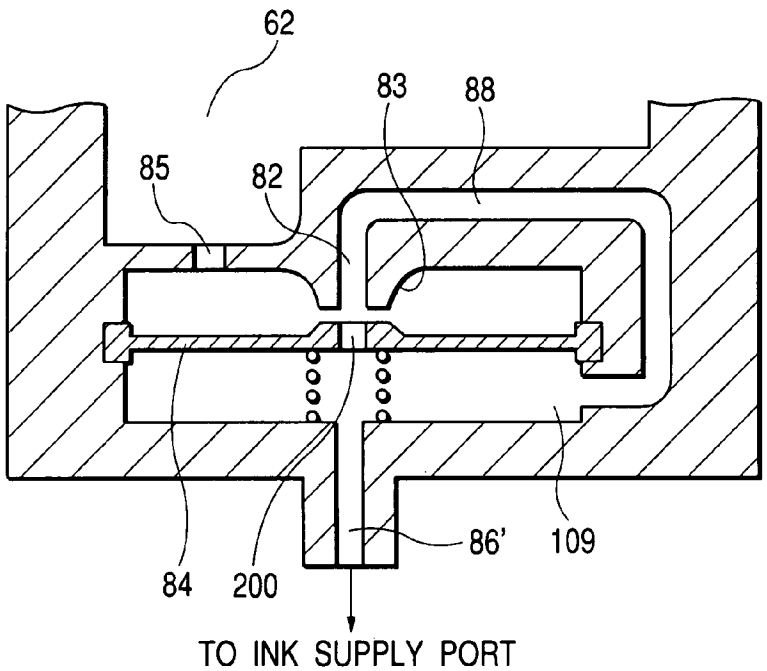
FIGS. 19A and 19B show other embodiments of a flow path structure in the negative pressure generating mechanism in the ink cartridge according to the present invention.
Figure 19A:
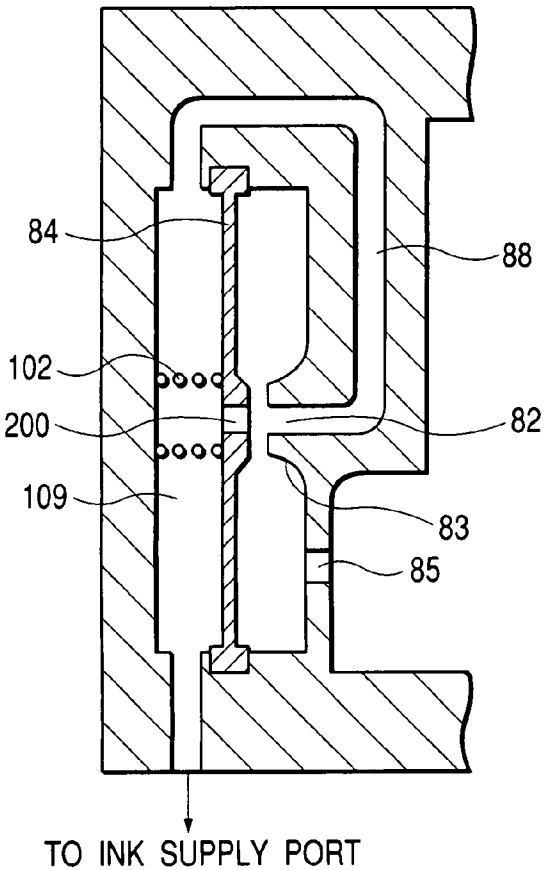

In the aforementioned embodiment, the back surface side of the valve member 84 is constructed to face and block off the closed space 109 that communicates with the exterior via the communication passage 87, whereby only ink flowing via the opening 200 into the closed space 109 is allowed to flow via the passage 87 into the ink supply port. However, the invention is not restricted thereto or thereby. For example, as shown in FIG. 19A or 19B, the flow passage 88 for fluid communication between the opening 82 and the ink supply port may be connected to one end of the closed space 109 behind the valve member 84, so that the back surface region of the valve member 84 serves also as an ink flow passage for ink flowing via the opening 82. In addition, the vertical arrangement of the valve member 84 as shown in FIG. 19A helps to insure any bubble passing through opening 85 will float upward along the valve member to the top of the chamber and not be drawn into openings 82 and 200.

By forming an ink outflow passage 86' that communicates with the pressure operating compartment 109 behind the valve member 84 and that is perpendicular to the surface of the valve member 84, as shown in FIG. 19B, it is possible to use the ink cartridge with the valve member 84 in a horizontal orientation.

Figure 20B:
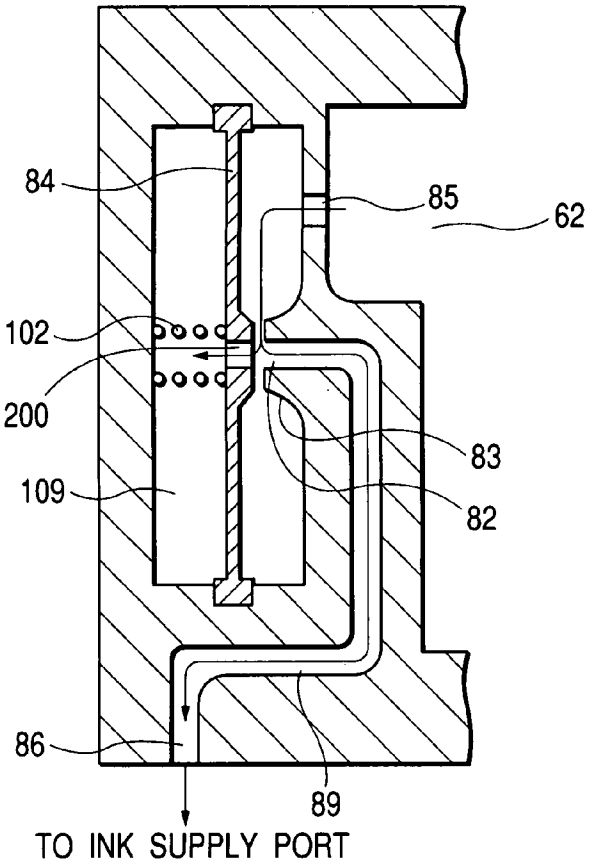
FIGS. 20A and 20B show another embodiment of another embodiment of a flow path structure in the negative pressure generating mechanism in the ink cartridge according to the present invention.
Figure 20A:
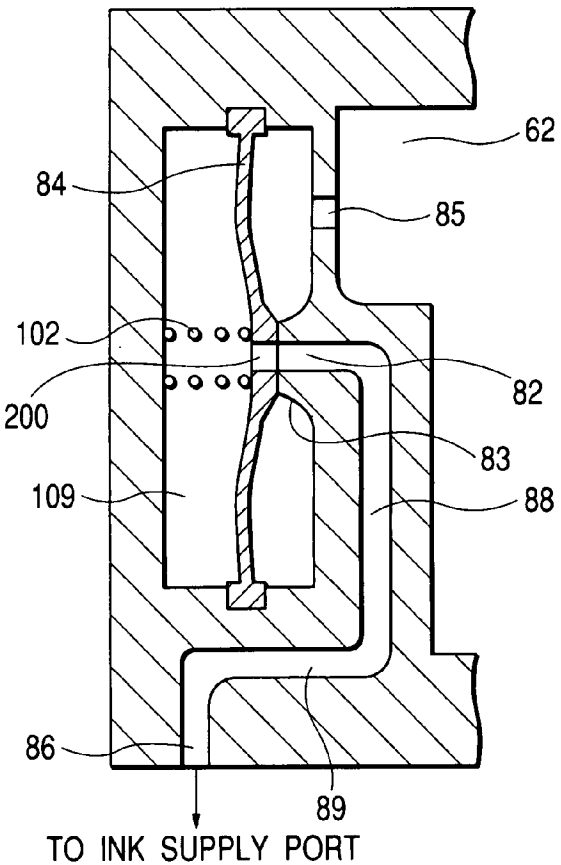

In the aforementioned embodiment, the closed space 109 on the back surface side of the valve member 84 communicates with the ink supply port via the passage 87. However, the invention is not restricted thereto or thereby. For example, as shown in FIGS. 20A and 20B, the passage 87 may be omitted, so that the closed space 109 communicates with the ink supply port only via the opening 200. This modification can simplify the flow passage design of the ink supply flow passage forming member 67.

Figure 21:
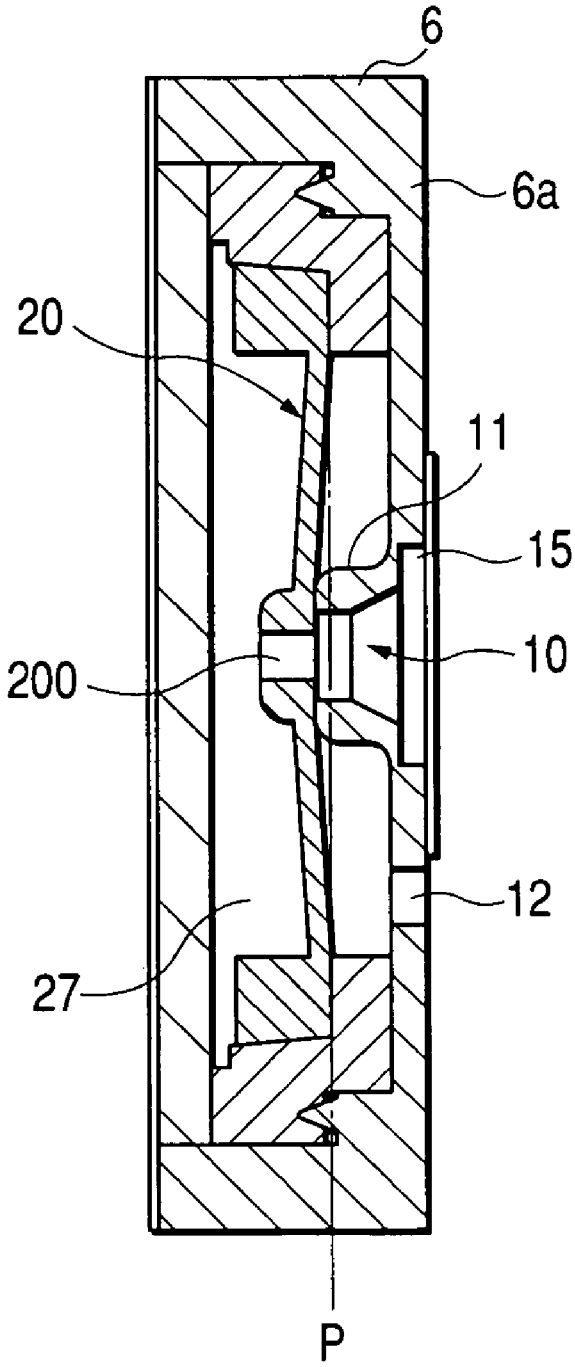
FIG. 21 is a sectional view showing another embodiment of the negative pressure generating mechanism.

In addition, taking, for instance, the embodiment shown in FIG. 4 as an example, the differential pressure adjusting spring 22 is disposed on the back surface of the valve member 20 and urges the valve member 20 so that the valve member 20 is in elastic contact with the protruding portion 11. The present invention should not, however, be restricted thereto or thereby. For example, as shown in FIG. 21, the valve member 20 may be made of elastic material, such as a rubber, and the protruding portion 11 may be relatively projected toward the valve member 20 side beyond a plane P that is formed by the undeformed valve body 20 itself in the protruding portion's absence. In this case, the valve member 20 can be maintained in elastic contact with the protruding portion 11 through the inherent elasticity of the valve member 20 itself This way, a biasing member, such as the spring 22, can be dispensed with.

Alternatively, the valve body 20 can be biased through the combination of its own deformation against a protruding portion 11 together with a suitably positioned biasing spring.

Although the present invention has been described with reference to an ink cartridge that can be detachably mounted to the recording head, the present invention is applicable to an ink tank (an ink cartridge) of a type in which a recording head is fixed to an ink storing member such as the ink tank. In this case, the ink supply port discussed above encompasses a boundary area at which the ink storing member is connected to the recording head, that is, the ink supply port means an ink inflow port or portion of the recording head.

Figure 22:
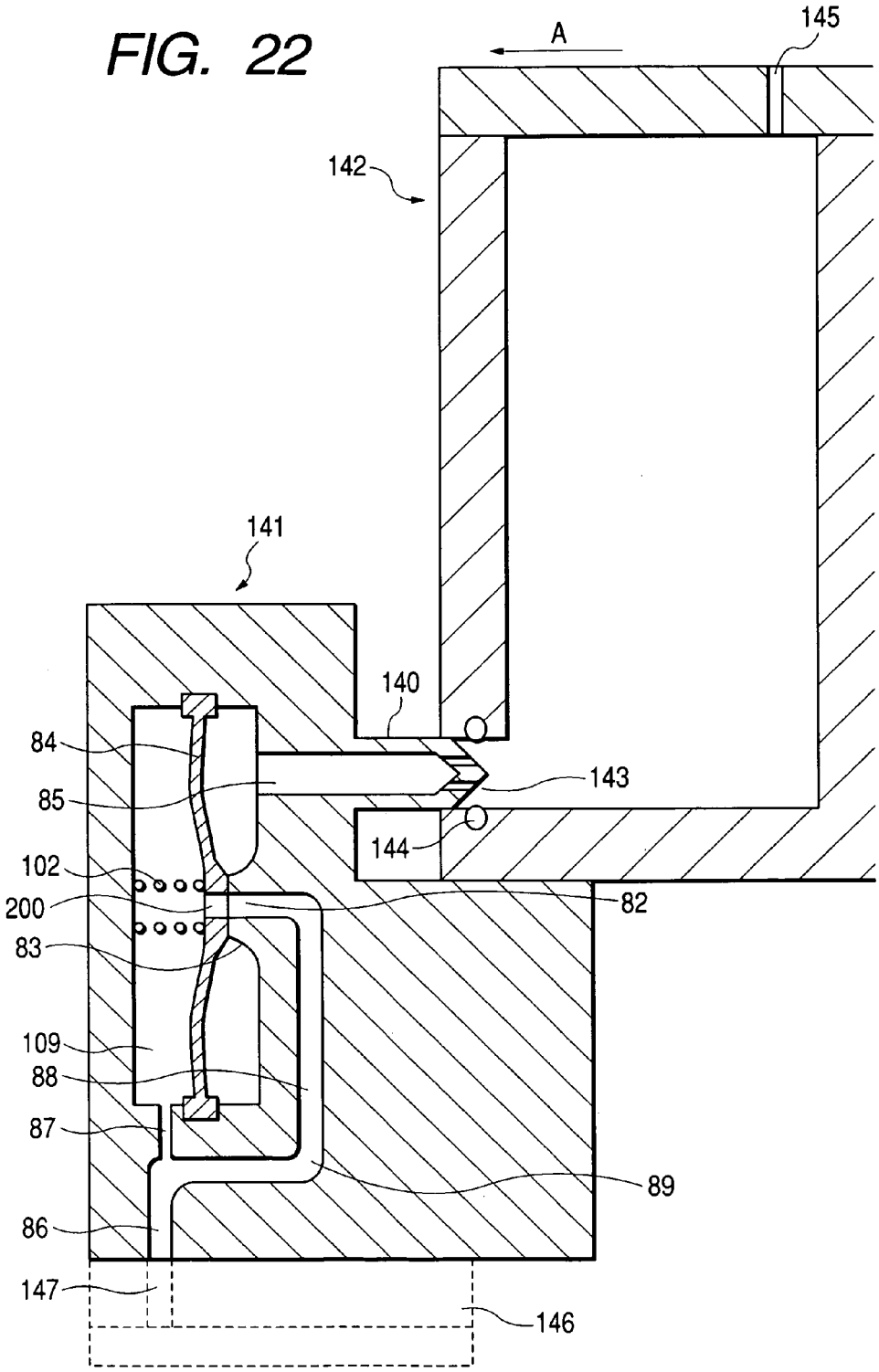
FIG. 22 is a sectional view showing an embodiment of a fluid flow controller for a recording head, which employs the principles of the present invention.

FIG. 22 shows an embodiment of a fluid flow controller or a liquid supply device that positively employs the operation principle of the valve member as mentioned above to supply ink to a recording head, while maintaining a negative pressure in the passage 86 from which ink flows to the ink inkflow port 147 of the recording head. In this embodiment, the region immediately upstream of the valve member 84 (that is, the region corresponding to the ink storing chamber 62 of FIGS. 18A and 18B) is omitted, and instead, a connection member, such as the hollow needle 140 shown in this embodiment, is provided to construct a valve structure device 141. The valve structure device 141 is detachably connectable to an external device, such as an ink tank or ink container 142 storing ink therein, via the connection member.

The ink container 142 is formed at its lower portion with an ink outflow port 143 that is engageable in liquid-tight fashion with the hollow needle 140. In the case of a new, unused ink container 142, a sealing film (not shown) that can be pieced by the hollow needle 140 seals the ink outflow port 143 in order to prevent the leakage of ink. In addition, reference numeral 144 in the drawing designates an annular packing adapted to be elastically contacted with the outer circumference of the hollow needle 140. Reference numeral 145 designates an atmosphere communication hole.

The portions of this invention necessary for the valve member 84 to function as discussed above can be provided in the form of an independent device, i.e. the valve structure device 141. In this arrangement, the recording head 146 is fixed to the bottom portion of the valve structure device 141, and the ink inflow port 147 of the recording head 146 is connected to the ink outflow port (the flow passage designated by reference numeral 86) of the valve structure device 141. The ink container 142 can be mounted by inserting the ink container 142 in the direction indicated by arrow A to supply ink to the recording head 146, and can be replaced by moving and withdrawing the ink container 142 in the opposite direction.

In addition, the operation and effect of the valve structure device 141 in this embodiment is the same as the aforementioned embodiments, and therefore the valve structure device 141, when integrated with the ink container 142, functions in the same manner as the ink cartridge described above.

Although the ink container 142 is directly connected (mounted) to the connection member (the hollow needle 140) in the embodiment mentioned above, the same effect can be obtained when the connection member is connected via a tube to an ink cartridge installed in a main body of the recording apparatus.

Features and advantages of the embodiments according to the present invention will be summarized as follows:

(1) The present invention provides an ink cartridge comprising: an ink storage chamber storing ink therein; an ink supply port communicating with the ink storage chamber; and a negative pressure generating mechanism which is disposed between the ink storage chamber and the ink supply port and which controls supply of ink of the ink storage chamber into the ink supply port The negative pressure generating mechanism including a first ink flow path communicating with the ink supply port; a sealing portion formed with an opening portion communicating with the first ink flow path; an elastic member having a through-hole which corresponds in location to the sealing portion and which can contact with and separate from the sealing portion; a communicating portion provided on a first surface side of the elastic member and communicating with the ink storage chamber; and a space portion provided on a second surface side of the elastic member and communicating with the ink supply port.

According to this arrangement, in a case that the elastic member separates from the sealing portion in response to a negative pressure at an ink outflow port, the opening portion of the sealing portion and the through-hole of the elastic member each act as an ink flow passage to supply ink to the ink outflow port with reduced flow passage resistance. Therefore, it is possible to provide an ink cartridge which can be accommodated to large amount of ink consumption at a recording head and which is suitable for high speed printing.

(2) In the ink cartridge according to (1), the elastic member separates from the sealing portion in response to lowering of pressure at the ink supply port side, thereby making it possible to supply ink via the opening portion or the through-hole into the ink supply port.

According to this arrangement, in a case that the elastic member separates from the sealing portion in response to a negative pressure at an ink outflow port, the opening portion of the sealing portion and the through-hole of the elastic member each act as an ink flow passage to supply ink to the ink outflow port with reduced flow passage resistance. Therefore, it is possible to provide an ink cartridge which can be accommodated to large amount of ink consumption at a recording head and which is suitable for high speed printing.

(3) In the ink cartridge according to (1), the elastic member is formed with a protrusion, and the through-hole is formed through the protrusion.

According to this arrangement, a large space can be ensured around the protrusion, thereby lowing flow passage resistance caused in association with ink flow.

(4) In the ink cartridge according to (1), the negative pressure generating mechanism further includes a second ink flow path through which the space portion communicates with the ink supply port.

According to this arrangement, ink flow into the ink supply port can be formed by the first ink flow path and the second ink flow path, and therefore a large amount of ink can be smoothly supplied to the ink supply port.

(5) In the ink cartridge according to (1), the space portion communicates with the ink supply port via the through-hole, the opening portion and the first ink flow path.

According to this arrangement, the control for the elastic member can be realized by a simple structure, while the increase of flow passage resistance caused in association with ink flow can be suppressed by the opening portion.

(6) In the ink cartridge according to (1), the negative pressure generating mechanism further includes a partition wall that is disposed at an upstream side of the elastic member and that defines a compartment between the elastic member and the partition wall, the partition wall having a protruding portion against which the elastic member elastically presses, and the opening portion is formed in the protruding portion.

According to this arrangement, in a state in which ink is supplied by separation of the elastic member from the opening portion, a space as large as possible can be ensured around the protruding portion, thereby suppressing dynamic pressure loss associated with ink flow. That is, the protruding portion can be formed by the same material as that of a container main body, a protruding amount (a height) of the protruding portion can be set in an arbitrary manner, and design freedom for a shape of the protruding portion and a shape of the through-hole can be increased.

(7) In the ink cartridge according to (6), the negative pressure generating mechanism further includes a biasing member that is disposed opposite to the protruding portion and which urges the elastic member toward the protruding portion.

According to this arrangement, the elastic member can be reliably brought into contact with the protruding portion regardless of posture of the elastic member. Therefore, sealing ability can be maintained regardless of movement of a carriage, vibration applied from an exterior, etc. Further, a contact force (a sealing force) by which the elastic member contacts the protruding portion can be easily set to an optimal value, i.e. a value that can prevent separation of the elastic member due to the carriage movement and that can maintain a suitable negative pressure for supplying ink, by adjusting a basing force (an elastic force) of the biasing member. In particular, in a case that a coil spring is used as the biasing member, the adjustment can be made easily and accurately.

(8) In the ink cartridge according to (6), the elastic member is urged toward the protruding portion by elastic deformation of the elastic member.

According to this arrangement, without increasing the number of component parts, the elastic member can be reliably brought into contact with the protruding portion regardless of posture of the elastic member, and sealing ability can be maintained regardless of movement of a carriage, vibration applied from an exterior, etc.

(9) In the ink cartridge according to (6), the opening portion of the protruding portion is disposed to substantially face a center of the elastic member.

According to this arrangement, a central region of the elastic member is deformed symmetrically with respect to the center, while keeping a substantially planar shape. For this reason, the opening portion can be reliably sealed to enhance the sealing ability.

(10) In the ink cartridge according to (1), the space portion is arranged so that a pressure caused in a downstream side of the elastic member by consumption of ink is applied to a substantially entire area of the second surface side of the elastic member.

According to this arrangement, contact/separation of elastic member with/from the sealing portion can be controlled by receiving the pressure change at the ink supply port by a large area, and therefore the opening of the ink flow path can be conducted only by the pressure change suitable for supplying ink.

(11) In the ink cartridge according to (1), the first ink flow path is connected via the space portion to the ink supply port.

According to this arrangement, ink in the space portion can also be supplied to the ink supply port, and therefore even if an air bubble exists within the space portion, the air bubble can be easily discharged from the space portion.

(12) In the ink cartridge according to (1), the first ink flow path connecting the ink supply port to the opening portion branches at an intermediate position to define a branching passage, and the branching passage is connected to the space portion that applies the pressure onto a substantially entire area of the second surface of the elastic member.

According to this arrangement, ink can be supplied using a plurality of flow passage, without complicating a flow passage structure in the vicinity of the ink supply port.

(13) In the ink cartridge according to (1), the first and the second surfaces of the elastic member contacts ink over a substantially same area.

According to this arrangement, a pressure difference can be readily caused between the first surface side of the elastic member and the second surface side thereof, to thereby reliably causing the movement of the elastic member.

(14) In the ink cartridge according to (1), the opening portion includes a cylindrical portion located at an elastic member side and an flared portion flaring outward moving along the flared portion in a direction of ink flow toward the ink supply port.

According to this arrangement, the elastic member contacts an area of the cylindrical portion, to thereby ensure reliable sealing ability, and the flared portion enlarges an opening area of the opening portion, to thereby reduce flow passage resistance.

(15) In the ink cartridge according to (1), at least a contact region of the elastic member, which contacts the sealing portion, is formed as a planar surface.

According to this arrangement, the sealing portion and the elastic member can be brought into contact with each other reliably. Further, the alignment of the sealing portion with respect to the elastic member can be easily performed.

(16) In the ink cartridge according to (1), the negative pressure generating mechanism further includes a biasing member that presses the through-hole of the elastic member into contact with the sealing portion.

According to this arrangement, the elastic member can be reliably brought into contact with the sealing portion regardless of posture of the elastic member. Therefore, sealing ability can be maintained regardless of movement of a carriage, vibration applied from an exterior, etc. Further, a contact force (a sealing force) by which the elastic member contacts the sealing portion can be easily set to an optimal value, i.e. a value that can prevent separation of the elastic member due to the carriage movement and that can maintain a suitable negative pressure for supplying ink, by adjusting a basing force (an elastic force) of the biasing member. In particular, in a case that a coil spring is used as the biasing member, the adjustment can be made easily and accurately.

(17) In the ink cartridge according to (1), the first ink flow path is formed by a recessed portion formed in an ink supply flow passage forming member, and a film sealing the recessed portion.

(18) In the ink cartridge according to (17), the opening portion is formed by a through-hole formed through the ink supply flow passage forming member.

According to these arrangements (17) and (18), the ink flow path and/or the opening portion can be constructed by a simple structure.

(19) In the ink cartridge according to (1), the ink cartridge is further constructed by a frame member having the ink supply port, and a lid member sealingly closing an opening surface of the frame member, and a region in which the negative pressure generating mechanism is installed is formed integral with or discrete from the frame member.

According to this arrangement, in a case that the installing region is integral with the frame member, the manufacture is easy. The other case that the installing region is discrete from the frame member is suitable for realizing a complicated structure since the installing region and the frame member can be manufactured separately and then assembled together.

(20) In the ink cartridge according to (1), the ink storage chamber is divided into an upper ink storage chamber sealed from an atmosphere and a lower ink storage chamber opened to the atmosphere, the upper ink storage chamber communicates with the lower ink storage chamber via a flow passage, and the negative pressure generative mechanism is disposed in a flow passage connecting the upper ink storage chamber to the ink supply port.

According to this arrangement, the pressure change applied to the elastic member in the negative pressure generating mechanism can be limited, while taking into account only the pressure change caused due to the change of the ink amount within the lower ink storage chamber. Therefore, there is no need to set the contact force, by which the elastic member contacts the sealing portion, to an excessively large value, and it is possible to provide an ink cartridge, in which a remaining ink amount can be reduced, without setting the contact force to the excessively large value.

(21) In the ink cartridge according to (1), the opening portion is constructed as a through-hole formed through a protruding portion having a planar surface portion at a distal end thereof.

According to this arrangement, the contact with the elastic member can be realized reliably.

(22) In the ink cartridge according to (21), the protruding portion is conical in section.

(23) In the ink cartridge according to (22), the opening portion includes a flared portion flaring outward moving along the flared portion in a direction of ink flow toward the ink supply port.

According to these arrangements (22) and (23), it is possible to reduce flow passage resistance during ink flow.

(24) In the ink cartridge according to (1), the through-hole is formed at a center of the elastic member.

According to this arrangement, the elastic member is deformed symmetrically with respect to the center, and therefore the contact with the sealing portion can be made reliable.

(25) In the ink cartridge according to (1), the elastic member is shaped as a disc.

According to this arrangement, the deformation of the elastic member can be made uniform, and the contact with the sealing portion as well as the deformation when the pressure change occurs can be made reliable.

(26) The present invention also provides an ink flow controller comprising: an elastic member having a first and a second surfaces and a through-hole, and movable in response to a pressure differential between the first and second surfaces; a sealing portion having an opening portion which can contact with and separate from the through-hole and which communicates with an ink outflow port; a communicating portion provided on a side of the first surface of the elastic member and adapted to communicate with an ink tank storing ink therein; and a space portion provided on a side of the second surface of the elastic member and communicating with the ink outflow port.

According to this arrangement, in a case that the elastic member separates from the sealing portion in response to a negative pressure at an ink outflow port, the opening portion of the sealing portion and the through-hole of the elastic member each act as an ink flow passage to supply ink to the ink outflow port with reduced flow passage resistance. Therefore, it is possible to provide an ink flow controller which can be accommodated to large amount of ink consumption at a recording head and which is suitable for high speed printing.

(27) In the fluid flow controller according to (26), a partition wall is disposed at an upstream side of the elastic member to define a compartment between the elastic member and the partition wall, the partition wall having a protruding portion against which the elastic member elastically presses, and the opening portion is formed in the protruding portion.

According to this arrangement, in a state in which ink is supplied by separation of the elastic member from the opening portion, a space as large as possible can be ensured around the protruding portion, thereby suppressing dynamic pressure loss associated with ink flow. That is, the protruding portion can be formed by the same material as that of a container main body, a protruding amount (a height) of the protruding portion can be set in an arbitrary manner, and design freedom for a shape of the protruding portion and a shape of the through-hole can be increased.

(28) In the fluid flow controller according to (27), a biasing member is disposed opposite to the protruding portion and urges the elastic member toward the protruding portion.

According to this arrangement, the elastic member can be reliably brought into contact with the protruding portion regardless of posture of the elastic member. Therefore, sealing ability can be maintained regardless of movement of a carriage, vibration applied from an exterior, etc. Further, a contact force (a sealing force) by which the elastic member contacts the protruding portion can be easily set to an optimal value, i.e. a value that can prevent separation of the elastic member due to the carriage movement and that can maintain a suitable negative pressure for supplying ink, by adjusting a basing force (an elastic force) of the biasing member. In particular, in a case that a coil spring is used as the biasing member, the adjustment can be made easily and accurately.

(29) In the fluid flow controller according to (27), the elastic member is urged toward the protruding portion by elastic deformation of the elastic member.

According to this arrangement, without increasing the number of component parts, the elastic member can be reliably brought into contact with the protruding portion regardless of posture of the elastic member, and sealing ability can be maintained regardless of movement of a carriage, vibration applied from an exterior, etc.

(30) In the fluid flow controller according to (27), the opening portion is disposed to substantially face a center of the elastic member.

According to this arrangement, a central region of the elastic member is deformed symmetrically with respect to the center, while keeping a substantially planar shape. For this reason, the opening portion can be reliably sealed to enhance the sealing ability.

Although the present invention has been described and illustrated in detail, it is clearly understood that the same is by way of illustration and example only and is not to be taken by way of limitation, the spirit and scope of the present invention being defined only by the terms of the accompanying claims.

What is claimed is:

1. An ink cartridge comprising:

an ink storage chamber;

an ink supply port; and a negative pressure generating mechanism which selectively blocks and opens fluid communication between the ink storage chamber and the ink supply port as a consequence of consumption of ink, the negative pressure generating mechanism including, an elastic member having first and second surfaces and a sealing portion, the sealing portion having a through-hole;

an ink flow path communicating with the ink supply port and having an opening portion at a position where the sealing portion of the elastic member contacts with and separates from the opening portion, the opening portion facing the through-hole;

a communicating portion facing the first surface of the elastic member and communicating with the ink storage chamber; and a space portion facing the second surface of the elastic member and communicating with the ink supply port.

2. The ink cartridge according to claim 1, wherein when the sealing portion of the elastic member separates from the opening portion, ink in the communicating portion flows via the opening portion into the ink supply port and also via the through-hole into the ink supply port.

3. The ink cartridge according to claim 1, wherein the sealing portion of the elastic member is constructed as a protrusion protruded from the first surface.

4. The ink cartridge according to claim 1, wherein the space portion communicates with the ink supply port via an ink flow path different from the ink flow path having the opening portion.

5. The ink cartridge according to claim 1, wherein the space portion communicates with the ink supply port via the through-hole and the opening portion.

6. The ink cartridge according to claim 1, wherein the negative pressure generating mechanism further includes a partition wall that is disposed at an upstream side of the elastic member and that defines a compartment between the elastic member and the partition wall, the partition wall having a protruding portion against which the sealing portion of the elastic member presses, and the opening portion of the ink flow path is formed in, the protruding portion.

7. The ink cartridge according to claim 6, wherein the negative pressure generating mechanism further includes a biasing member that is disposed opposite to the protruding portion and which urges the elastic member toward the protruding portion.

8. The ink cartridge according to claim 6, wherein the elastic member is urged toward the protruding portion by elastic deformation of the elastic member.

9. The ink cartridge according to claim 6, wherein the opening portion of the protruding portion is disposed to substantially face a center of the elastic member.

10. The ink cartridge according to claim 6, wherein a flow passage of the ink flow path includes a first portion that communicates the opening portion of the protruding portion with the ink supply port, and the flow passage branches at an intermediate position to define a branching passage, the space portion includes a closed space the pressure in which is applied onto a substantially entire area of the second surface of the elastic member, and the branching passage is in fluid communication with the closed space.

11. The ink cartridge according to claim 1, wherein the space portion includes a compartment that faces the second surface of the elastic member, the compartment being arranged so that consumption of ink causes a change in a pressure applied to a downstream side of the elastic member, and the change in the pressure is applied to a substantially entire area of the second surface of the elastic member.

12. The ink cartridge according to claim 1, wherein ink in the ink storage chamber flows via a flow passage connecting the ink storage chamber to the first surface of the elastic member, the opening portion of the ink flow path, a flow passage connected to the opening portion of the ink flow path, the space portion facing the second surface of the elastic member and a flow passage connecting the space portion to the ink supply port, in this order, into the ink supply port.

13. The ink cartridge according to claim 1, wherein the first and the second surfaces of the elastic member contacts ink over a substantially same area.

14. The ink cartridge according to claim 1, wherein the opening portion of the ink flow passage includes a cylindrical portion located at an elastic member side and an flared portion flaring outward moving along the flared portion in a direction of ink flow toward the ink supply port.

15. The ink cartridge according to claim 1, wherein at least the sealing portion of the elastic member, which contacts the opening portion, is formed as a planar surface.

16. The ink cartridge according to claim 1, wherein the negative pressure generating mechanism further includes a biasing member that presses the sealing portion of the elastic member into contact with the opening portion.

17. The ink cartridge according to claim 1, wherein the ink flow path is formed at least partly by a recessed portion formed in an ink supply flow passage forming member, and a film sealing the recessed portion.

18. The ink cartridge according to claim 17, wherein the opening portion is formed by a through-hole formed through the ink supply flow passage forming member.

19. The ink cartridge according to claim 1, further comprising a frame member having the ink supply port, and a lid member sealingly closing an opening surface of the frame member, and a region in which the negative pressure generating mechanism is installed is formed integral with or discrete from the frame member.

20. The ink cartridge according to claim 1, wherein the ink storage chamber is divided into an upper ink storage chamber sealed from an atmosphere and a lower ink storage chamber opened to the atmosphere, the upper ink storage chamber communicates with the lower ink storage chamber via a flow passage, and the negative pressure generative mechanism is disposed in a flow passage connecting the upper ink storage chamber to the ink supply port.

21. The ink cartridge according to claim 1, wherein the opening portion is constructed as a through-hole formed through a protruding portion having a planar surface portion at a distal end thereof.

22. The ink cartridge according to claim 21, wherein the protruding portion is conical in section.

23. The ink cartridge according to claim 22, wherein the opening portion includes a flared portion flaring outward moving along the flared portion in a direction of ink flow toward the ink supply port.

24. The ink cartridge according to claim 1, wherein the through-hole is formed at a center of the elastic member.

25. The ink cartridge according to claim 1, wherein the elastic member is shaped as a disc.

26. The ink cartridge according to claim 1 wherein the communicating portion includes a compartment that faces the first surface of the elastic member, the compartment being arranged so that a pressure of ink stored in the ink storage chamber is applied to a substantially entire area of the first surface of the elastic member.

27. A fluid flow controller for a recording head, comprising:

an elastic member having a first and a second surfaces and a sealing portion, and movable in response to a pressure differential between the first and second surfaces, the sealing portion having a through-hole;

a communicating portion facing the first surface of the elastic member and adapted to communicate with an ink tank storing ink therein;

an ink outflow port;

an opening portion of an ink flow path, which communicates with the ink outflow port, wherein the sealing portion of the elastic member is arranged for movement into contact with and separation from the opening portion; and a space portion facing the second surface of the elastic member and communicating with the ink outflow port.

28. The fluid flow controller according to claim 27, wherein when the sealing portion of the elastic member separates from the opening portion, ink in the communicating portion flows via the opening portion into the ink outflow port and also via the through-hole into the ink outflow port.

29. The fluid flow controller according to claim 27, wherein the sealing portion of the elastic member is constructed as a protrusion protruded from the first surface.

30. The fluid flow controller according to claim 27, wherein the space portion communicates with the ink outflow port via an ink flow path different from the ink flow path having the opening portion.

31. The fluid flow controller according to claim 27, wherein the space portion communicates with the ink outflow port via the through-hole and the opening portion.

32. The fluid flow controller according to claim 27, wherein a partition wall is disposed at an upstream side of the elastic member to define a compartment between the elastic member and the partition wall, the partition wall having a protruding portion against which the sealing portion of the elastic member presses, and the opening portion of the ink flow path communicating with the ink outflow port is formed in the protruding portion.

33. The fluid flow controller according to claim 32, wherein a biasing member is disposed opposite to the protruding portion and urges the elastic member toward the protruding portion.

34. The fluid flow controller according to claim 32, wherein the elastic member is urged toward the protruding portion by elastic deformation of the elastic member.

35. The fluid flow controller according to claim 32, wherein the opening portion of the protruding portion is disposed to substantially face a center of the elastic member.

36. The fluid flow controller according to claim 27, wherein the communicating portion includes a compartment that faces the first surface of the elastic member, the compartment being arranged so that a pressure of ink stored in the ink tank is applied to a substantially entire area of the first surface of the elastic member.

37. A method of regulating ink flow from an ink cartridge, having an ink supply port, to an ink jet head, comprising the steps of:

providing, as part of the ink cartridge, a valve chamber having a cover and a base, the base having both an inlet and an outlet, the valve chamber containing an elastic membrane having a through-hole, both the inlet and the outlet being disposed on a first side of the elastic membrane, and a space being defined between a second side of the elastic membrane and the cover, and pressing the elastic membrane toward the base with an applied force so that a contact portion of the elastic membrane seals the outlet and the through-hole from the inlet, wherein, when a pressure in the space decreases beyond a given value, a resulting pressure differential across the elastic membrane causes the contact portion of the elastic membrane to move away from the outlet against the applied force, thereby communicating the outlet and the through-hole with the inlet.

38. A method according to claim 37, further comprising the step of causing the pressure in the space to be the same as a pressure in the ink supply port.

39. A method according to claim 38, wherein the step of causing is accomplished by providing a fluid path between the space and the ink supply port.

40. A method according to claim 38, further comprising the step of:

allowing ink to flow from the inlet via the outlet into the ink supply port and also via the through-hole and the space into the ink supply port until the pressure in the space increases to the given value.

* * * * *